US009874834B2

(12) United States Patent
Inada

(10) Patent No.: US 9,874,834 B2
(45) Date of Patent: Jan. 23, 2018

(54) TONER CONTAINER AND IMAGE FORMING APPARATUS INCLUDING SHUTTER TO OPEN AND CLOSE PASSING PORT

(71) Applicant: KYOCERA Document Solutions Inc., Osaka (JP)

(72) Inventor: Teruhiko Inada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/275,683

(22) Filed: Sep. 26, 2016

(65) Prior Publication Data

US 2017/0097587 A1 Apr. 6, 2017

(30) Foreign Application Priority Data

Oct. 2, 2015 (JP) ..... 2015-196984

(51) Int. Cl.
*G03G 15/08* (2006.01)

(52) U.S. Cl.
CPC ..... *G03G 15/0886* (2013.01); *G03G 15/0875* (2013.01); *G03G 2215/0692* (2013.01)

(58) Field of Classification Search
CPC ..... G03G 15/0886; G03G 2215/0692; G03G 15/0875; Y10S 222/01
See application file for complete search history.

(56) References Cited

U.S. PATENT DOCUMENTS 8,811,862 B2 8/2014 Nagashima
2002/0085857 A1* 7/2002 Kim ..... G03G 21/1832 399/119
2003/0068174 A1* 4/2003 Hashimoto ..... G03G 15/0844 399/120
2006/0291909 A1* 12/2006 Park ..... G03G 15/0875 399/258
2007/0092302 A1* 4/2007 Koyama ..... G03G 15/0868 399/258
2008/0013984 A1* 1/2008 Mihara ..... G03G 15/0872 399/106
2010/0166460 A1* 7/2010 Maeshima ..... G03G 15/0868 399/119
2010/0178080 A1* 7/2010 Huang ..... G03G 15/0886 399/262
2012/0033998 A1* 2/2012 Hori ..... G03G 15/0886 399/258

FOREIGN PATENT DOCUMENTS

JP 2013113928 A 6/2013

* cited by examiner

*Primary Examiner* — David M Gray
*Assistant Examiner* — Laura Roth
(74) *Attorney, Agent, or Firm* — Studebaker & Brackett PC

(57) ABSTRACT

An image forming apparatus includes a toner container and a shutter mechanism. The toner container is attached to or detached from an apparatus main body along an attachment/detachment direction. The toner container has a passing port. The shutter mechanism has a container mount, a shutter plate and an opening/closing hook. The container mount is attached to the toner container. The shutter plate is supported on the container mount so as to be slidable along the attachment/detachment direction. The opening/closing hook is supported on the apparatus main body on one side in a direction crossing the attachment/detachment direction. The opening/closing hook disengages the shutter plate with the container mount.

8 Claims, 22 Drawing Sheets

TONER CONTAINER AND IMAGE FORMING APPARATUS INCLUDING SHUTTER TO OPEN AND CLOSE PASSING PORT

INCORPORATION BY REFERENCE

This application is based on and claims the benefit of priority from Japanese Patent application No. 2015-196984 filed on Oct. 2, 2015, the entire contents of which are incorporated herein by reference.

BACKGROUND

The present disclosure relates to a toner container and an image forming apparatus to which the toner container is attachable and detachable.

In an electrographic image forming apparatus, an electrostatic latent image formed on an image carrier is developed into a toner image by a development device and then the toner image is transferred to a recording sheet to thereby carry out image forming. If the amount of the toner in the development device decreases below a predetermined amount, the toner is replenished from a toner container to the development device.

The toner container is formed with a discharge port from which the toner is discharged. By discharging the toner from the discharge port into a replenishment port provided at the development device, the toner is replenished to the development device. There may be a case in which the discharge port of the toner container or the replenishment port of the development device is opened or closed by a shutter member of a slide type.

There is an image forming apparatus provided with an attachable and detachable processing unit. The processing unit includes an image forming unit having a drum unit and a development unit, and an intermediate transferring belt. The drum unit has a photosensitive drum, a charging device and a cleaning device. The charging device and the cleaning device are disposed around the photosensitive drum. The development unit has a development device disposed close to the photosensitive drum. As downsizing of the image forming apparatus advances, a distance between the drum unit and the development unit also decreases; and in the case of a full-color image forming apparatus, a distance between the image forming units also decreases.

In addition, in order to correspond to such an image forming apparatus, a toner cartridge is sometimes used. The toner cartridge includes a replenishment toner container and a collection toner container which are integrally provided each other. The replenishment toner container is configured to store the toner to be replenished to the development unit. The collection toner container is configured to store the cleaned and collected toner. As described above, if the distance between the drum unit and the development unit or the distance between the image forming units decreases, the distance between the toner cartridges also decreases.

Accordingly, there is a need for the toner cartridge which is capable of replenishing the toner from the replenishment toner container to the development unit or collecting the toner from the drum unit into the collection toner container even in such a small space.

SUMMARY

In accordance with an embodiment of the present disclosure, an image forming apparatus includes a toner container and a shutter mechanism. The toner container is attached to or detached from an apparatus main body along a predetermined attachment/detachment direction. The toner container has a passing port through which a toner is supplied or discharged. The shutter mechanism is configured to open or close the passing port. The shutter mechanism has a container mount, a shutter plate and an opening/closing hook. The container mount is attached to the toner container. The shutter plate is supported on the container mount so as to be slidable along the attachment/detachment direction. The opening/closing hook is supported on the apparatus main body on one side in a direction crossing the attachment/detachment direction. The container mount has a mount side engagement part and a guide part. The mount side engagement part protrudes from a side face on the one side in a direction of the one side. The guide part protrudes from the side face in the direction of the one side and extends along the attachment/detachment direction. The shutter plate has a shutter arm. The shutter arm is supported in a cantilever manner on a side face on the one side. The shutter arm has a shutter side engagement part capable of engaging with the mount side engagement part. The opening/closing hook has a hook arm. The hook arm is biased towards the side face of the container mount. The hook arm has a hook claw. The hook claw is guided along the guide part in accordance with the attachment/detachment of the toner container to be engaged with the shutter arm and then to move the shutter arm in the direction of the one side so as to disengage the shutter side engagement part with the mount side engagement part. The disengagement of the shutter side engagement part with the mount side engagement part by the hook claw makes it possible to slide the shutter plate relative to the container mount and then to open or close the passing port.

In accordance with an embodiment of the present disclosure, a toner container attached to or detached from an apparatus main body along a predetermined attachment/detachment direction and having a passing port through which a toner is supplied or discharged includes a shutter mechanism. The shutter mechanism is configured to open or close the passing port. The shutter mechanism has a container mount and a shutter plate. The container mount is attached to the toner container. The shutter plate is supported on the container mount so as to be slidable along the attachment/detachment direction. The container mount has a mount side engagement part protruding from a side face on one side in a direction crossing the attachment/detachment direction. The shutter plate has a shutter arm. The shutter arm is supported in a cantilever manner on a side face on the one side. The shutter arm has a shutter side engagement part capable of engaging with the mount side engagement part. The shutter arm is moved in a direction of the one side so as to disengage the shutter side engagement part with the mount side engagement part so that the shutter plate can be slid relative to the container mount and then open or close the passing port.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
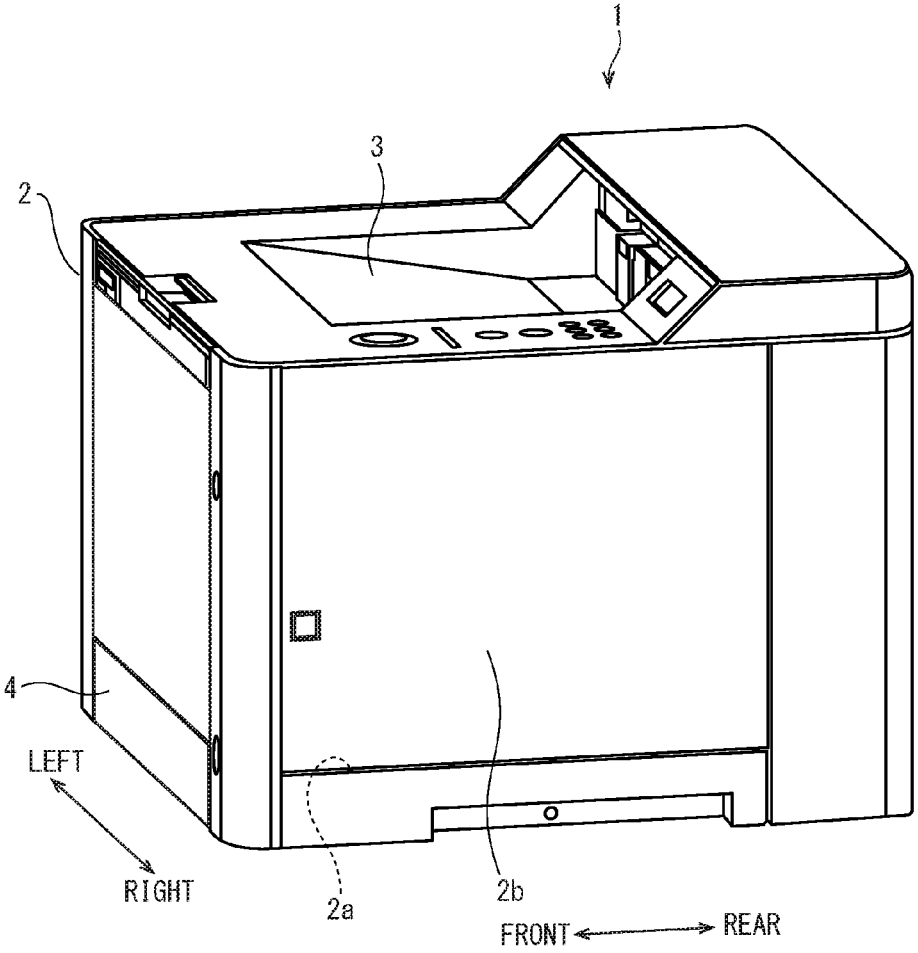
FIG. 1 is a perspective view showing a color printer according to the embodiment of the present disclosure.
Figure 2:
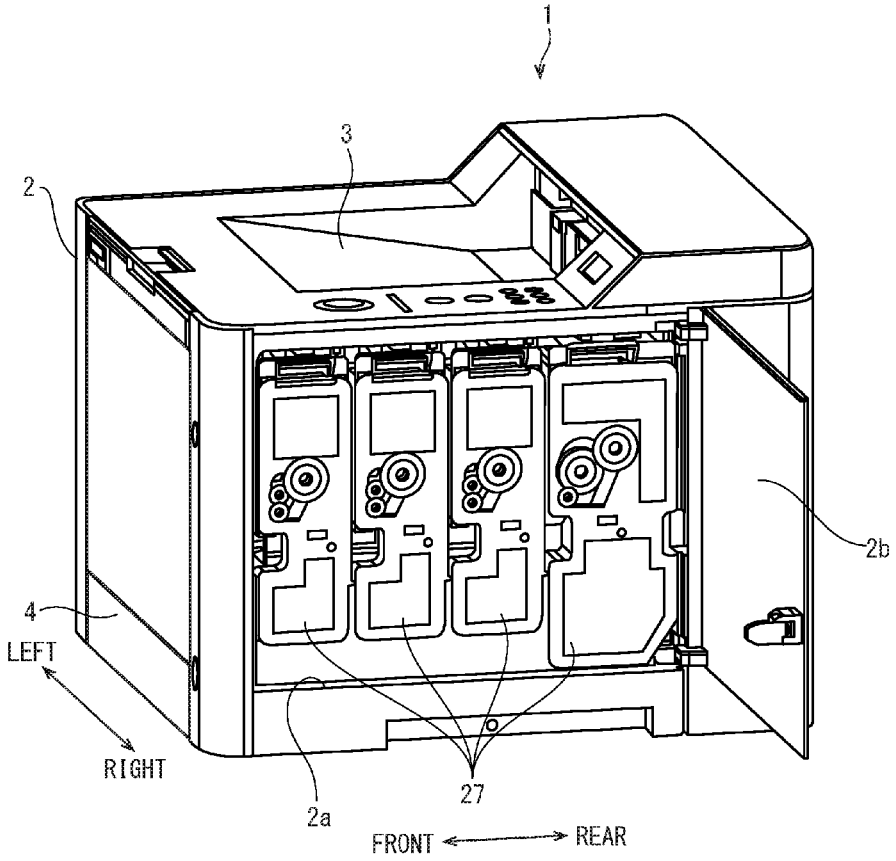
FIG. 2 is a perspective view showing an opened toner cartridge attachment opening, in the color printer according to an embodiment of the present disclosure.
Figure 3:
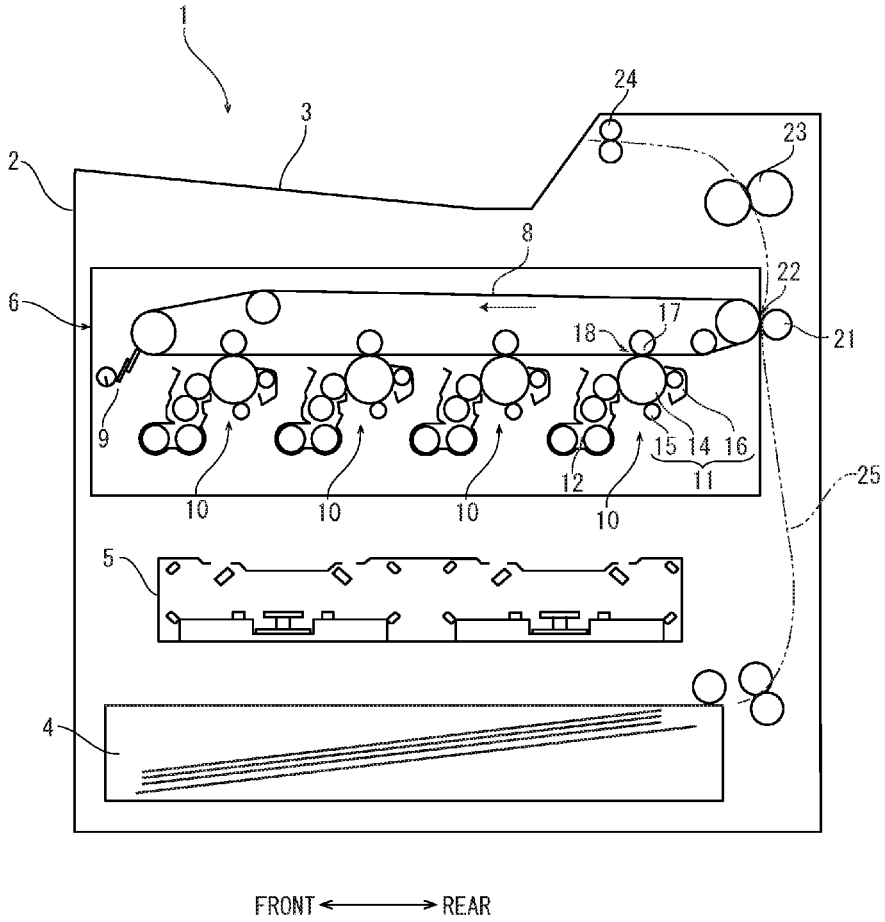
FIG. 3 is a view schematically showing an internal structure of the color printer according to the embodiment of the present disclosure.

First, with reference to FIG. 1 to FIG. 3, an entire structure of a color printer 1 as an image forming apparatus will be described. FIG. 1 is a perspective view showing the color printer, FIG. 2 is a perspective view showing a toner cartridge attachment opening opened by turning a cover of the color printer and FIG. 3 is a view schematically showing an internal structure of the color printer. In the following description, front and rear directions and right and left directions respectively show front and rear directions and right and left directions indicated in FIG. 1.

As shown in FIG. 1, an apparatus main body 2 of the color printer 1 has a rectangular parallelepiped shape. On an upper face of the apparatus main body 2, an ejected sheet tray 3 is formed. As shown in FIG. 3, inside the apparatus main body 2, a sheet feeding cassette 4, an exposure device 5 and a processing unit 6 are installed. The sheet feeding cassette 4 is disposed in the lower portion of the apparatus main body 2. The exposure device 5 is disposed above the sheet feeding cassette 4 and the processing unit 6 is disposed above the exposure device 5. The processing unit 6 is configured to form an image in an electrographic manner using toners of four colors.

The processing unit 6 is provided with an intermediate transferring belt 8, a belt cleaning device 9 and four image forming units 10. The intermediate transferring belt 8 is supported between a driving roller and a driven roller via tension rollers. The driving roller and the driven roller are disposed at a predetermined interval in the front and rear directions so that the intermediate transferring belt 8 is turned along the front and rear directions. The belt cleaning device 9 is disposed facing the driving roller via the intermediate transferring belt 8. The four image forming units 10 are disposed below the intermediate transferring belt 8 along the front and rear directions.

Each of the image forming units 10 includes a drum unit 11 and a development unit 12. The drum unit 11 has a rotatable photosensitive drum 14 as an image carrier, a charger 15 and a drum cleaning device 16. The charger 15 and the drum cleaning device 16 are arranged around the photosensitive drum 14 along the rotating direction of the photosensitive drum 14. A first transferring roller 17 is disposed between the charger 15 and the drum cleaning device 16 via the intermediate transferring belt 8. Between the intermediate transferring belt 8 and the photosensitive drum 14, a first transferring part 18 is formed. The development unit 12 is disposed close to the photosensitive drum 14 between the charger 15 and the first transferring part 18 in the rotating direction of the photosensitive drum 14.

On a rear side of the processing unit 6, a second transferring roller 21 is disposed facing the intermediate transferring belt 8. Between the second transferring roller and the intermediate transferring belt 8, a second transferring part 22 is formed. Above the second transferring part 22, a fixing device 23 is installed. Above the fixing device 23, a sheet ejecting device 24 is installed. Inside the apparatus main body 2, a sheet conveying path 25 is formed so as to extend from the sheet feeding cassette 4 toward the sheet ejecting device 24 through the second transferring part 22 and the fixing device 23.

As shown in FIG. 2, on a right side face of the apparatus main body 2, a toner cartridge attachment/detachment opening 2*a* is formed. The toner cartridge attachment/detachment opening 2*a* is opened and closed by a cover 2*b*. Inside the toner cartridge attachment/detachment opening 2*a*, four toner cartridges 27 are disposed along the front and rear directions. The four toner cartridges 27 respectively contain toners of four colors (yellow, magenta, cyan and black) each corresponding to the image forming unit. The toner cartridges 27 are detachably attached to a holder (not shown) provided inside the toner cartridge attachment/detachment opening 2*a*. The toner cartridges 27 are attached to or detached from the toner cartridge attachment/detachment opening 2*a* along the left and right directions.

Next, the operation of forming an image by the color printer 1 having such a configuration will be described. In each image forming unit 10, after a surface of the photosensitive drum 14 is charged by the charger 15, the exposure device 5 exposes the surface of the photosensitive drum 14 with a laser light based on an image date to form an electrostatic latent image on the surface of the photosensitive drum 14. The electrostatic latent image is then developed into a toner image of corresponding color toner by the development unit 12. The toner image is first transferred on a surface of the intermediate transferring belt 8 at the first transferring part 18. The above operation is performed at each image forming unit 10 to form a full color toner image on the intermediate transferring belt 8. The toner remained on the photosensitive drum 14 is removed by the drum cleaning device 16.

On the other hand, the sheet fed from the sheet feeding cassette 4 is conveyed along the sheet conveying path 25 into the second transferring part 22 in a suitable timing with the above image forming operation. At the second transferring part 22, the full color toner image on the intermediate transferring belt 8 is second transferred on the sheet. The sheet on which the toner image is transferred is conveyed along the sheet conveying path 25 into the fixing device 23. At the fixing device 23, the toner image is fixed on the sheet. The sheet with the fixed toner image is ejected from the sheet ejecting device 24 on the ejected sheet tray 3. The toner remained on the intermediate transferring belt 8 is cleaned by the belt cleaning device 9.

Figure 4:
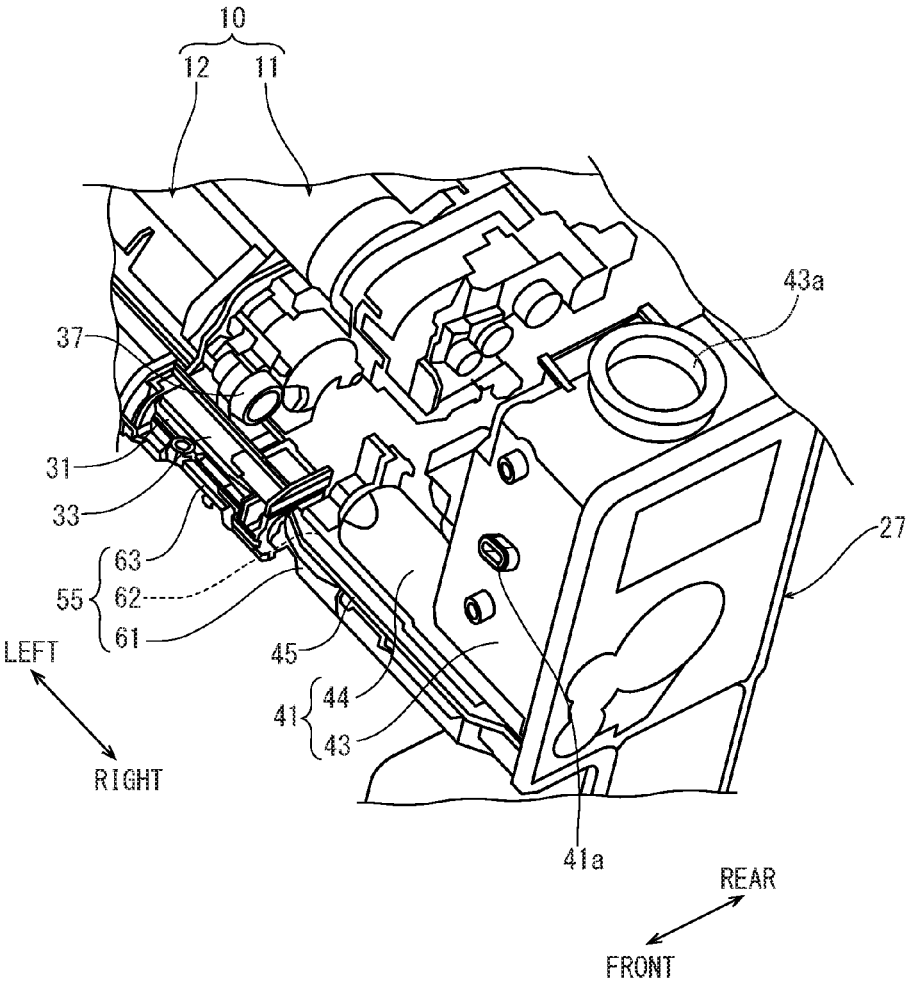
FIG. 4 is a perspective view showing an image forming unit and a toner cartridge, in the color printer according to the embodiment of the present disclosure.
Figure 5:
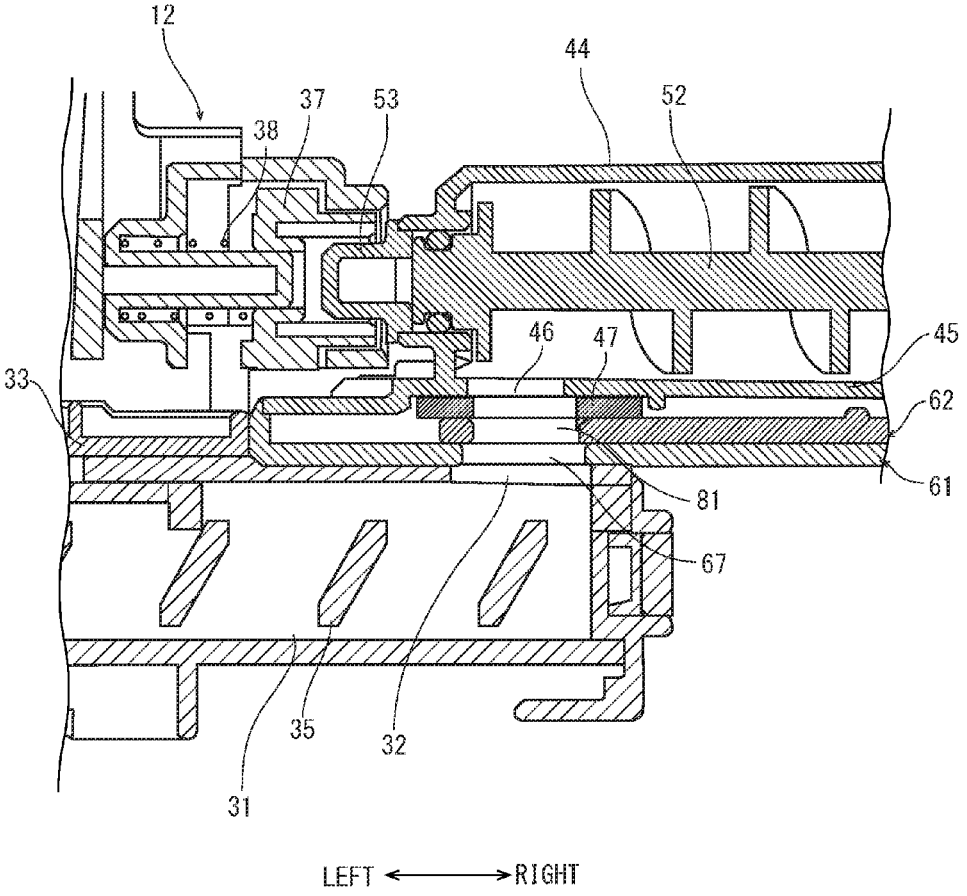
FIG. 5 is a sectional view showing the image forming unit and the toner cartridge, in the color printer according to the embodiment of the present disclosure.
Figure 6A:
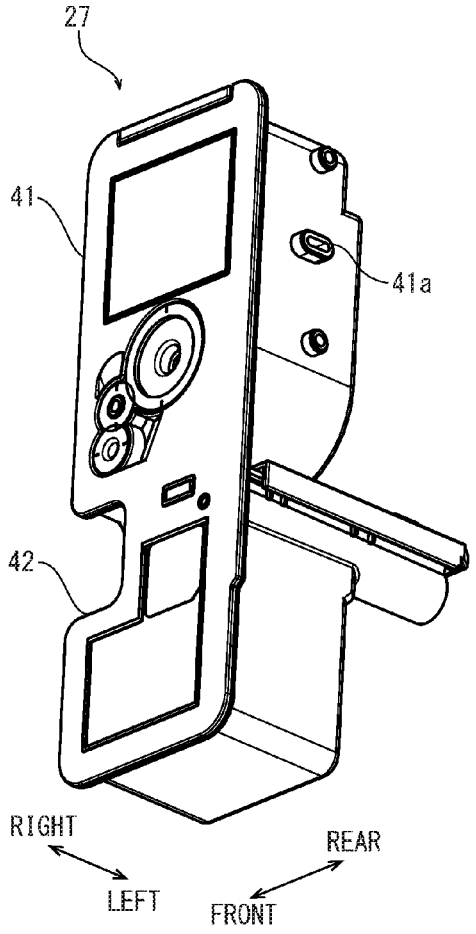
FIG. 6A is a perspective view showing the toner cartridge viewed from a right rear side, in the color printer according to the embodiment of the present disclosure.
Figure 6B:
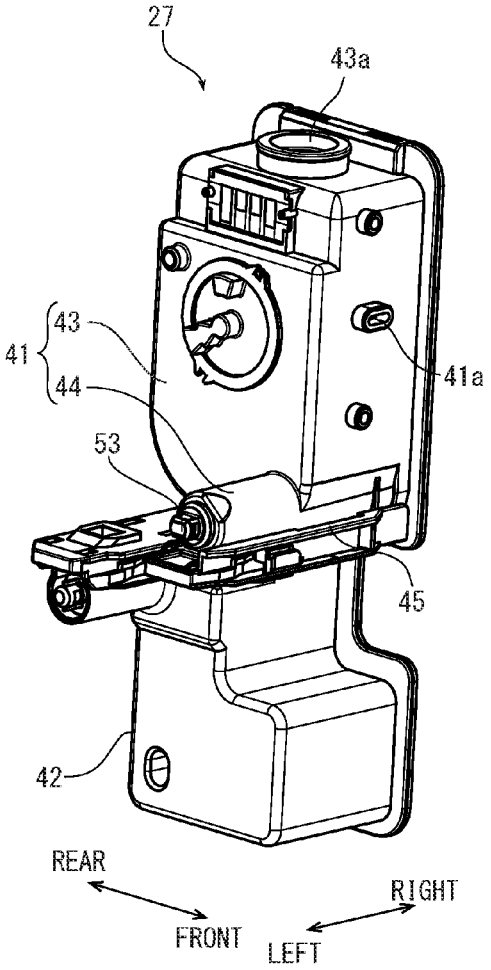
FIG. 6B is a perspective view showing the toner cartridge viewed from a left front side, in the color printer according to the embodiment of the present disclosure.
Figure 7:
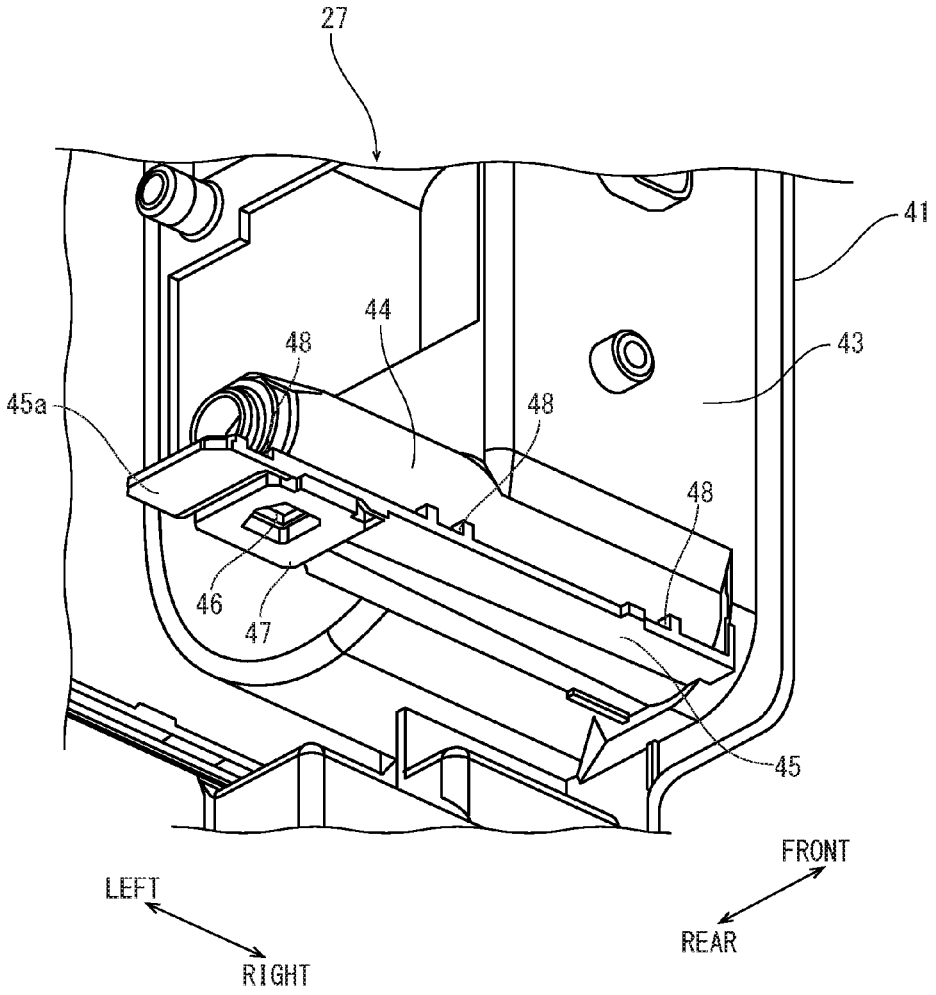
FIG. 7 is a perspective view showing a replenishment route of the toner cartridge viewed from a lower side, in the color printer according to the embodiment of the present disclosure.

Next, with reference to FIG. 4 to FIG. 7, the image forming unit 10 and the toner cartridge 27 will be described. FIG. 4 is a perspective view showing the image forming unit and the toner cartridge; FIG. 5 is a sectional side view showing the development unit; FIG. 6A and FIG. 6B each are a perspective view showing the toner cartridge; and FIG. 7 is a perspective view showing a replenishment route of the toner cartridge, viewed from a lower side. Incidentally, FIG. 6A and FIG. 6B each show the toner cartridge to which a container mount of a shutter mechanism, which will be described later, is mounted.

The image forming unit 10, as described above, includes the drum unit 11 and the development unit 12. As shown in FIG. 5, the development unit 12 is formed with a cylindrical replenishment route 31 protruding toward the toner cartridge attachment/detachment opening 2*a* (rightward). At a tip end portion of an upper face of the replenishment route 31, a replenishment port 32 is formed as a receptacle port into which toner is received. The replenishment port 32 is opened or closed by a unit side shutter plate 33. The unit side shutter plate 33 is supported to be slidable in a length direction of the replenishment route 31 (in the left and right directions) along the upper face of the replenishment route 31. Also, the unit side shutter plate 33 is biased by a spring member (not shown) in the right direction in which the replenishment port 32 is closed. In the replenishment route 31, an agitating screw 35 is supported. By rotating the agitating screw 35, the toner replenished from the replenishment port 32 is conveyed along the replenishment route 31.

In addition, the development unit 12 is provided with a rotatable driving coupling 37 protruding rightward above the replenishment route 31. The driving coupling 37 is biased rightward by a spring member 38.

The drum unit 11 is formed with a cylindrical discharge route (not shown) which communicates with the drum cleaning device 16 and protrudes toward the toner cartridge attachment/detachment opening 2*a*. At a lower end portion of a lower face of the discharge route, a discharge port (not shown) is formed. The discharging port is opened or closed by an opening and closing mechanism having the same mechanism as that of the development unit 12. Also, the drum unit 11 is provided with a driving coupling similar to that of the development unit 12. The opening and closing mechanism of the discharge port of the drum unit 11 and the driving coupling are not described herein.

With reference to FIG. 6A and FIG. 6B, the toner cartridge 27 will be described. The toner cartridge 27 is formed into a vertically long rectangular parallelepiped shape and has a toner storage part 41 and a toner collection part 42. The toner storage part 41 is a toner container in which the toner to be replenished to the development unit 12 is stored. The toner collecting part 42 is a toner container in which the toner collected by the drum cleaning device 16 of the drum unit 11 is stored. The toner storage part 41 and the toner collection part 42 are disposed to be vertically arranged.

The toner storage part 41 has a container main body 43 and a communication route 44. The container main body 43 stores a fresh toner. The communication route 44 protrudes toward the development unit 12 (leftward) from a lower corner of a left face of the container main body 43. On an upper face of the container main body 43, a charging port 43*a* into which the fresh toner is charged is formed. As shown in FIG. 7, on a lower face of the communication route 44, a flat plate-shaped mounting part 45 is formed. A tip end portion 45*a* of the mounting part 45 bends downward at a tip end of the communication route 44 and extends leftward over the tip end of the communication route 44.

The mounting part 45 is formed with a rectangular supply port 46 on an inner side (the right side) from the tip end portion 45*a*. The supply port 46 is a passing port through which the toner is passed. Around the supply port 46, a sealing member 47 is adhered. A lower face of the sealing member 47 and a lower face of the tip end portion 45*a* are on the same level each other. The supply port 46 opposes to the replenishment port 32 provided at the replenishment route 31 of the development unit 12 when the toner cartridge 27 is attached to the holder through the toner cartridge attachment/detachment opening 2*a*. In this manner, from the supply port 46 of the communication route 44, the toner drops into the replenishment port 32 of the replenishment route 31. Also, along both side edges in the length direction of the mounting part 45, a pair of protrusions 48 are respectively formed at predetermined intervals.

Inside the communication route 44, as shown in FIG. 5, an agitating screw 52 is rotatably supported. At a tip end (the left end) of the agitating screw 52, a driven coupling 53 is mounted. The driven coupling 53 protrudes leftward from the communication route 44 and is coupled with the driving coupling 37 of the development unit 12. If the driven coupling 53 is coupled with the driving coupling 37, the agitating screw 52 is rotated by rotation of the driving coupling 37, and the toner in the container main body 43 is conveyed to the supply port 46 along the communication route 44.

In addition, the toner storage part 41 is provided with a shutter mechanism 55 to open or close the supply port 46. The shutter mechanism 55 will be described later.

Incidentally, although the toner collection part 42 also has a similar construction to that of the toner storage part 41, they are different from each other in the following points. Namely, since the toner storage part 41 is configured such that the toner in the container main body 43 is supplied into the development unit 12 by its natural dropping, the supply port 46 of the toner storage part 41 is formed on the lower face of the communication route 44. On the other hand, since the toner collection part 42 is configured such that the toner collected from the drum unit 11 is collected by its natural dropping, the passing port of the toner collection part 42 is formed on the upper face of the communication route.

In addition, the toner cartridge 27 is formed with a boss 41*a* on each side face of the toner storage part 41. By using these bosses 41*a*, the toner cartridge 27 is positioned to the holder provided inside the toner cartridge attachment/detachment opening 2*a*.

Figure 8A:
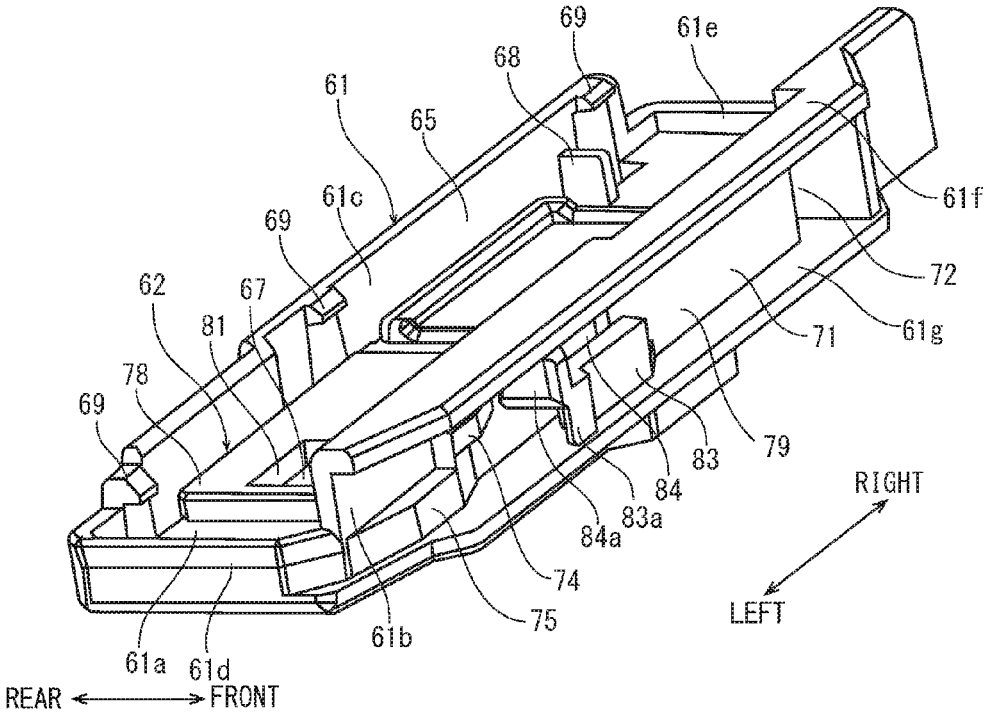
FIG. 8A is a perspective view showing a container mount on which a shutter plate is supported, in a shutter mechanism of the color printer according to the embodiment of the present disclosure.
Figure 8B:
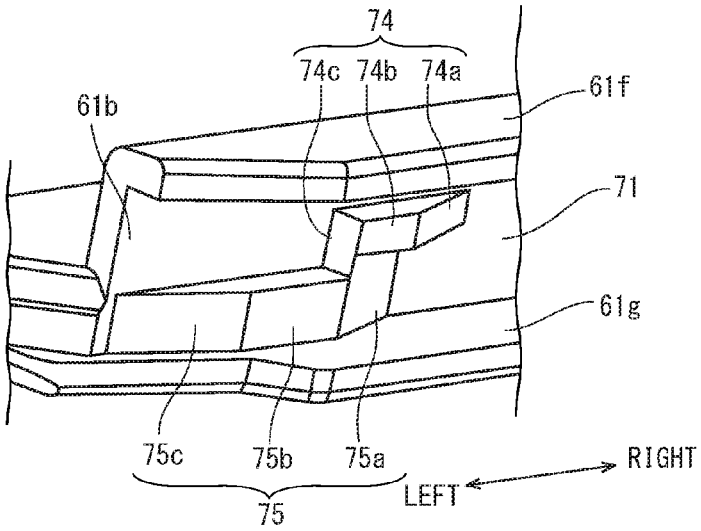
FIG. 8B is a perspective view enlarging and showing a part of the container mount, in the shutter mechanism of the color printer according to the embodiment of the present disclosure.
Figure 9A:
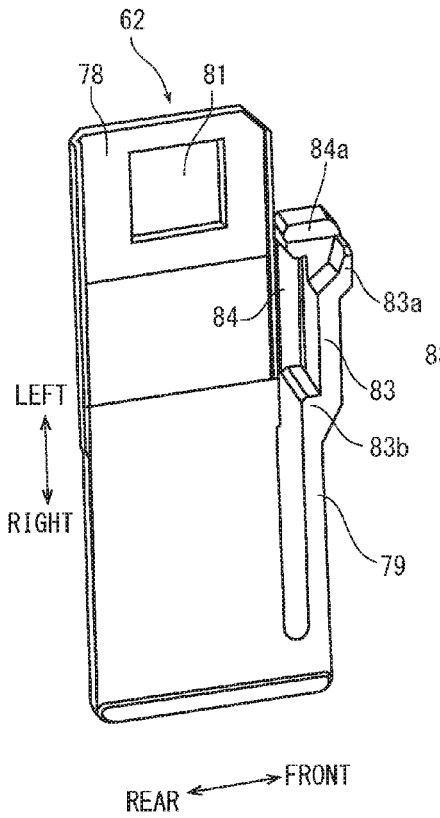
FIG. 9A is a perspective view showing the shutter plate viewed from a lower side, in the shutter mechanism of the color printer according to the embodiment of the present disclosure.
Figure 9B:
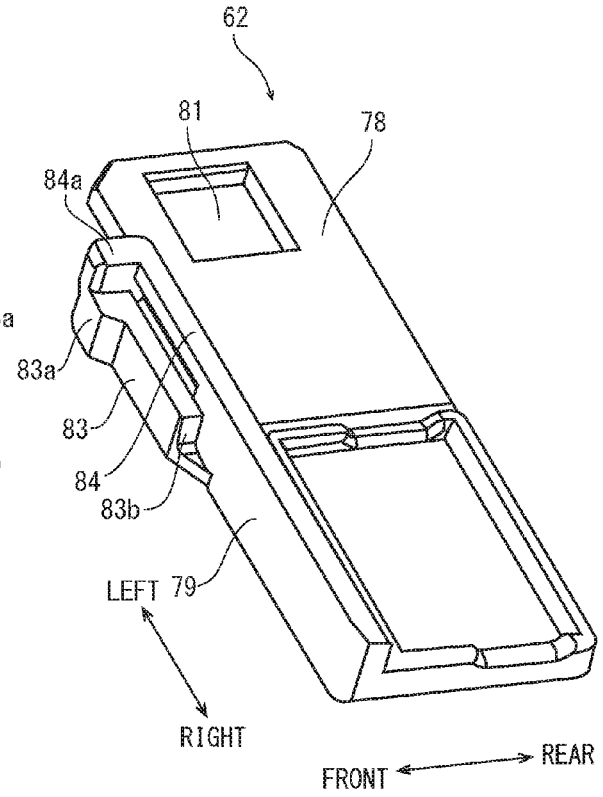
FIG. 9B is a perspective view showing the shutter plate viewed from an upper side, in the shutter mechanism of the color printer according to the embodiment of the present disclosure.
Figure 10:
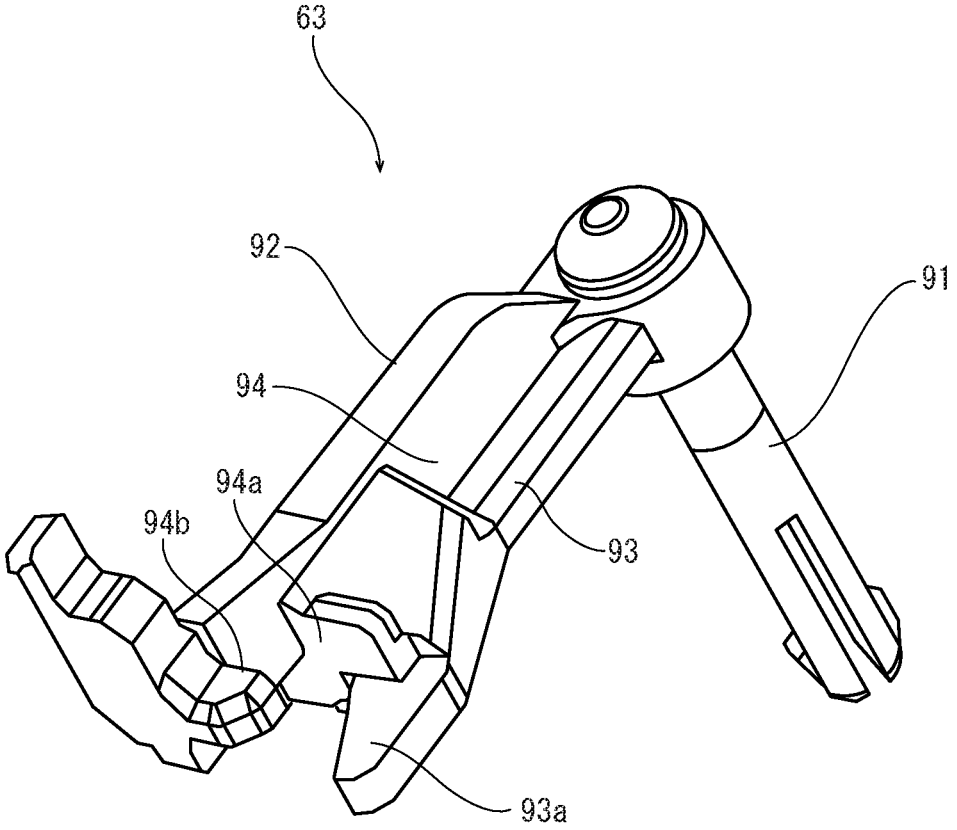
FIG. 10 is a perspective view showing an opening/closing hook, in the shutter mechanism of the color printer according to the embodiment of the present disclosure.

Next, with reference to FIG. 4 and FIG. 8 to FIG. 10, the shutter mechanism 55 will be described. FIG. 8A and FIG. 8B each are a perspective view showing a container mount on which a shutter plate is supported; FIG. 9A and FIG. 9B each are a perspective view showing the shutter plate; and FIG. 10 is a perspective view showing an opening/closing hook. Hereinafter, the shutter mechanism 55 to open or close the supply port 46 of the toner storage part 41 will be described. The shutter mechanism to open or close the passing port of the toner collection part 42 also has a similar construction.

The shutter mechanism 55, as shown in FIG. 4, includes a container mount 61, a shutter plate 62 and an opening/closing hook 63. The container mount 61 is mounted to the mounting part 45 provided at the communication route 44 of the toner storage part 41. The shutter plate 62 is supported between the container mount 61 and the mounting part 45. The opening/closing hook 63 is supported on the apparatus main body 2 in front of a coupling portion between the communication route 44 of the toner storage part 41 and the replenishment route 31 of the development unit 12.

The container mount 61, as shown in FIG. 8A, is a shallow box-shaped member elongated in the length direction (the left and right directions) of the mounting part 45. The container mount 61 has a shallow recess part 65 elongated in the left and right directions with its upper face open. The recess part 65 is surrounded by a rectangular bottom plate 61*a*, front and rear side plates 61*b*, 61*c*, and left and right side plates 61*d*, 61*e*. The bottom plate 61*a* is formed with a rectangular communication port 67 and a stopper 68. The communication port 67 is formed at a position spaced away from the left sideplate 61*d* by a predetermined interval. The stopper 68 is erected at a position spaced away from the right side plate 61*e* by a predetermined interval. Also, on inside faces of the front and rear side plates 61*b*, 61*c*, hooks 69 are respectively formed at predetermined intervals.

Along an upper edge and a lower edge of the front side plate 61*b*, an upper edge part 61*f* and a lower edge part 61*g* are formed protruding outward (forward) respectively. The upper and lower edge parts 61*f*, 61*g* and the front side plate 61*b* form a groove part 71. In the groove part 71, the front side plate 61*b* is formed with an opening 72 at the right end portion. Through the opening 72, the recess part 65 and the groove part 71 are communicated with each other.

In the groove part 71, the front side plate 61*b* is also formed with an abutment part 74 and a guide part 75 at the left end portion. The abutment part 74 is configured to be amount side engagement part to be engaged with the shutter plate 62. The guide part 75 is configured to guide a hook claw 93*a* (refer to FIG. 10) of the opening/closing hook 63. The abutment part 74 is disposed above the guide part 75. The abutment part 74 and the guide part 75 protrude forward and are formed along the left and right directions. As shown in FIG. 8B, the abutment part 74 has an inclined face 74*a*, a parallel face 74*b* and an end face 74*c* in order from the right to the left. The inclined face inclines forward. The parallel face 74*b* is substantially in parallel to the front side plate 61*b*. The end face 74*c* is substantially at a right angle with respect to the front side plate 61*b*. The guide part 75 has a right inclined face 75*a*, a parallel face 75*b* and a left inclined face 75*c* in order from the right to the left. The right inclined face 75*a* inclines forward. The parallel face 75*b* is substantially in parallel to the front side plate 61*b*. The left inclined face 75*c* inclines rearward. The abutment part 74 and the guide part 75 are arranged such that the parallel face 74*b* of the abutment part 74 and the right inclined face 75*a* of the guide part 75 are overlapped each other in the left and right directions.

The container mount 61 is attached to the mounting part 45 (refer to FIG. 7) provided in the communication route 44 of the toner storage part 41. In detail, the hooks 69 formed in the recess part 65 of the container mount 61 are engaged with the pair of protrusions 48 formed in the mounting part 45. In this manner, the upper face of the recess part 65 is covered with the mounting part 45, and the supply port 46 formed in the mounting part 45 and the communication port 67 formed in the bottom plate 61*a* of the container mount 61 oppose to each other in the vertical direction.

The shutter plate 62, as shown in FIG. 9, includes a main body part 78 and a shutter arm 79. The main body part 78 has a rectangular plate-shape elongated in the left and right directions. The shutter arm 79 is supported in a cantilever manner at a right end portion of a front face of the main body part 78. The shutter arm 79 is configured to elastically turn around its right end in a direction close to or spaced away from the main body part 78.

The main body part 78 has a slightly smaller width than that of the recess part 65 of the container mount 61. The main body part 78 is formed with a rectangular opening 81 at the left end portion. A portion on a center side from the opening 81 of an upper face of the main body part 78 is formed to be flat.

The shutter arm 79 extends along the front side face of the main body part 78 before the opening 81. Also, the shutter arm 79 has a thickness about two times of that of the main body part 78. A lower face of the shutter arm 79 is formed on the same level as the lower face of the main body part 78 and an upper face of the shutter arm 79 is formed on a higher level than an upper face of the main body part 78. At a tip end portion of the shutter arm 79, a lower arm part 83 and an upper arm part 84 are formed. The lower arm part 83 is formed outside of the upper arm part 84 via a stepped part 83*b*. As shown in FIG. 9A, the lower arm part 83 is formed with a shutter claw 83*a* at the tip end portion. The shutter claw 83*a* bends a left forward direction. The upper arm part 84 is formed with an engagement part 84*a* at the tip end portion. The engagement part 84 is configured to be a shutter side engagement part to be engaged with the abutment part 74 of the container mount 61. As shown in FIG. 9B, the engagement part 84*a* bends toward the tip end of the shutter claw 83*a*.

The shutter plate 62, as shown in FIG. 8A, is supported on the recess part 65 of the container mount 61. In detail, the main body part 78 of the shutter plate 62 is placed on the upper face of the bottom plate 61*a* of the recess part 65. The shutter arm 79 protrudes through the opening 72 of the front side plate 61*b*, and is housed in the groove part 71 along the front side plate 61*b*. The upper arm part 84 corresponds to the abutment part 74 formed in the groove part 71 in the front and rear directions. The lower arm part 83 corresponds to the guide part 75 in the front and rear directions. The shutter plate 62 slides in the left and right directions along the recess part 65 between a close position and an open position. At the close position, the opening 81 is spaced away leftward from the communication port 67 of the bottom plate 61*a* and then the communication port 67 is closed. At the open position, the opening 81 is communicated with the communication port 67 vertically. At the close position, a left end edge of the shutter plate 62 abuts against the left side plate 61*d* of the recess part 65. At the open position, a right end edge of the shutter plate 62 abuts against the stopper 68 erected on the bottom plate 61*a* of the recess part 65.

In addition, if the shutter plate 62 slides from the close position to the open position, the engagement part 84*a* formed at the upper arm part 84 of the shutter arm 79 runs along the inclined face 74*a* of the abutment part 74. The engagement part 84*a* passes through the parallel face 74*b* and then abuts against the end face 74*c*. In this manner, the sliding of the shutter plate 62 in the right direction, that is, in the direction toward the open position is prevented. Incidentally, if the shutter arm 79 is elastically deformed outward so as to space the engagement part 84*a* outward from the abutment part 74, the shutter plate 62 and the container mount 61 are disengaged from each other and therefore the shutter plate 62 can slide in the direction toward the open position with respect to the container mount 61.

The opening/closing hook 63, as shown in FIG. 10, includes a supporting shaft 91 and a hook arm 92. The supporting shaft 91 extends vertically. The hook arm 92 extends in the direction perpendicular to an axial direction of the supporting shaft 91 from the upper end portion of the supporting shaft 91. At a tip end portion of the hook arm 92, a lower stage part 93 and an upper stage part 94 are formed to be slightly spaced from each other in a circumferential direction of the supporting shaft 91. The lower stage part 93 is formed with a tapered hook claw 93*a*. The upper stage part 94 is formed with an inner abutment face 94*a* and an outer abutment face 94*b* which are spaced away from each other in the length direction of the hook arm 92 at a predetermined interval. The inner abutment face 94*a* is on a side close to the supporting shaft 91 and the outer abutment face 94*b* is on a side far from the supporting shaft 91. The inner abutment face 94*a* and the outer abutment face 94*b* oppose to each other in the length direction of the hook arm 92. The inner abutment face 94*a* and the outer abutment face 94*b* are respectively configured to be a depth side engagement part and a front side engagement part, both of which are capable of engaging with the engagement part 84*a* formed in the shutter arm 79.

The opening/closing hook 63, as shown in FIG. 4, is disposed in the front of the replenishment route 31 of the development unit 12. The supporting shaft 91 is supported on the apparatus main body 2 and the hook arm 92 extends rightward. Further, the supporting shaft 91 is biased by a torsion coil spring (not shown) so that the hook arm 92 turns in a direction close to the replenishment route 31.

As described hereinabove, when the container mount 61 in which the shutter plate 62 is housed is attached to the mounting part 45 of the toner storage part 41 and the opening/closing hook 63 is supported on the apparatus main body 2, the abutment part 74 of the container mount 61, the upper arm part 84 of the shutter plate 62 and the upper stage part 94 of the opening/closing hook 63 are disposed on the same height first position. Also, the guide part 75 of the container mount 61, the lower arm part 83 of the shutter plate 62 and the lower stage part 93 of the opening/closing hook 63 are disposed on the same height second position which is lower than the first height position.

Incidentally, a shutter mechanism provided in the toner collection part 42 also has a same construction as that of the shutter mechanism. 55 provided in the toner storage part 41.

An opening and closing operation of the shutter mechanism 55 having the above construction will be described. First, with reference to FIG. 11 to FIG. 18, an opening operation of the shutter mechanism 55 will be described. FIG. 11, FIG. 13, FIG. 15 and FIG. 17 are sectional plan views, each of which illustrates the opening operation of the shutter mechanism. "A" of each figure is a sectional view showing the shutter mechanism sectioned horizontally at the upper stage part of the opening/closing hook. "B" of each figure is a sectional view showing the shutter mechanism sectioned horizontally at the lower stage part of the opening/closing hook. FIG. 12, FIG. 14, FIG. 16, and FIG. 18 are sectional side views, each of which illustrates an opening operation of the replenishment port of the development unit.

Figure 11A:
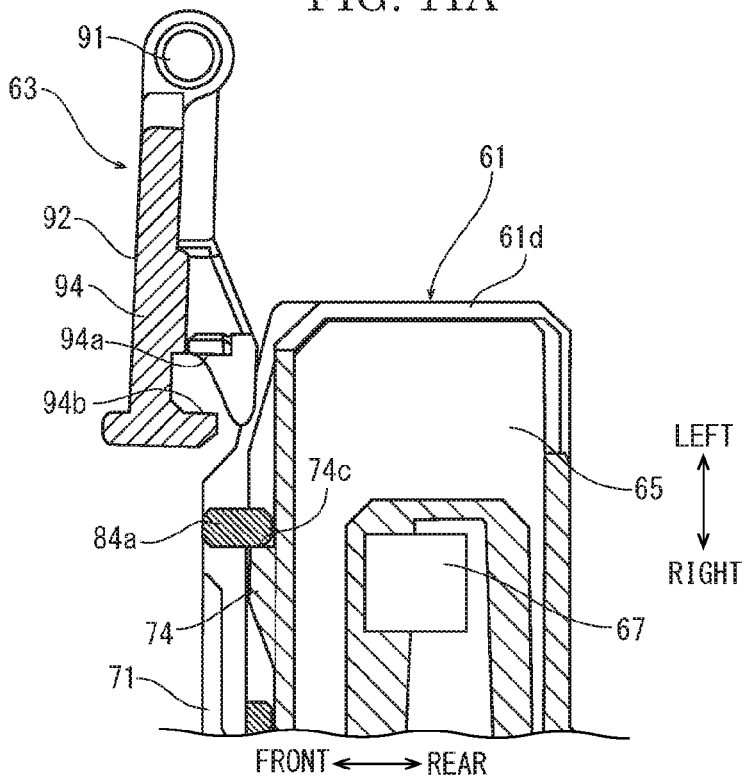
FIG. 11A is a sectional view showing the shutter mechanism sectioned horizontally at an upper stage part of the opening/closing hook when an opening operation is started, in the color printer according to the embodiment of the present disclosure.
Figure 11B:
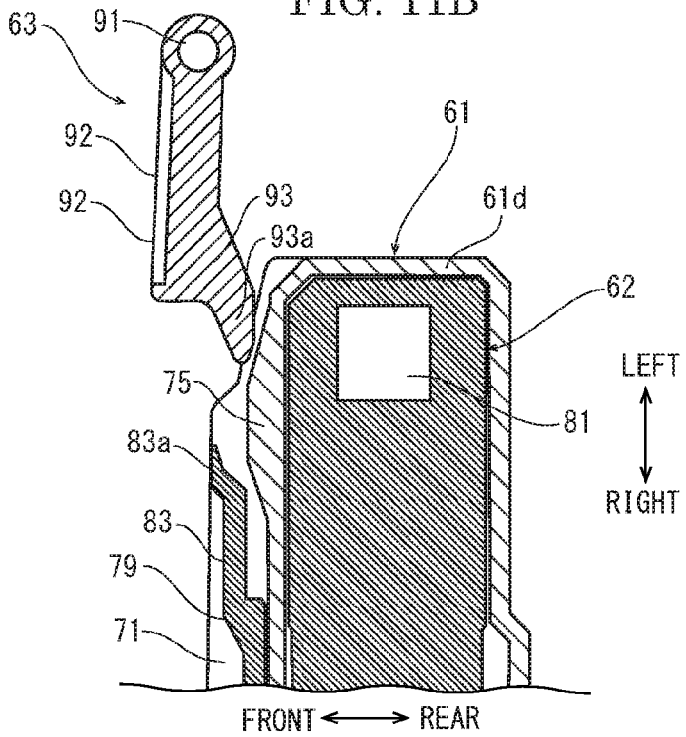
FIG. 11B is a sectional view showing the shutter mechanism sectioned horizontally at a lower stage part of the opening/closing hook when the opening operation is started, in the color printer according to the embodiment of the present disclosure.

In the toner cartridge 27, as described above, the container mount 61 is attached to the mounting part 45 of the toner storage part 41. As shown in FIG. 11B, the shutter plate 62 slides into the close position and then the opening 81 is spaced away from the communication port 67 of the bottom plate 61*a*. In addition, as shown in FIG. 11A, in the groove part 71 of the container mount 61, the engagement part 84*a* formed in the upper arm part 84 of the shutter arm 79 abuts against the end face 74*c* of the abutment part 74 formed in the groove part 71 of the container mount 61 so that the shutter plate 62 is prevented from being slid in the direction toward the open position.

When the toner cartridge 27 is attached to the holder leftward through the toner attachment/detachment opening 2*a*, as shown in FIG. 11B, the hook arm 92 of the opening/closing hook 63 starts to get into the groove part 71 of the container mount 61.

Figure 12:
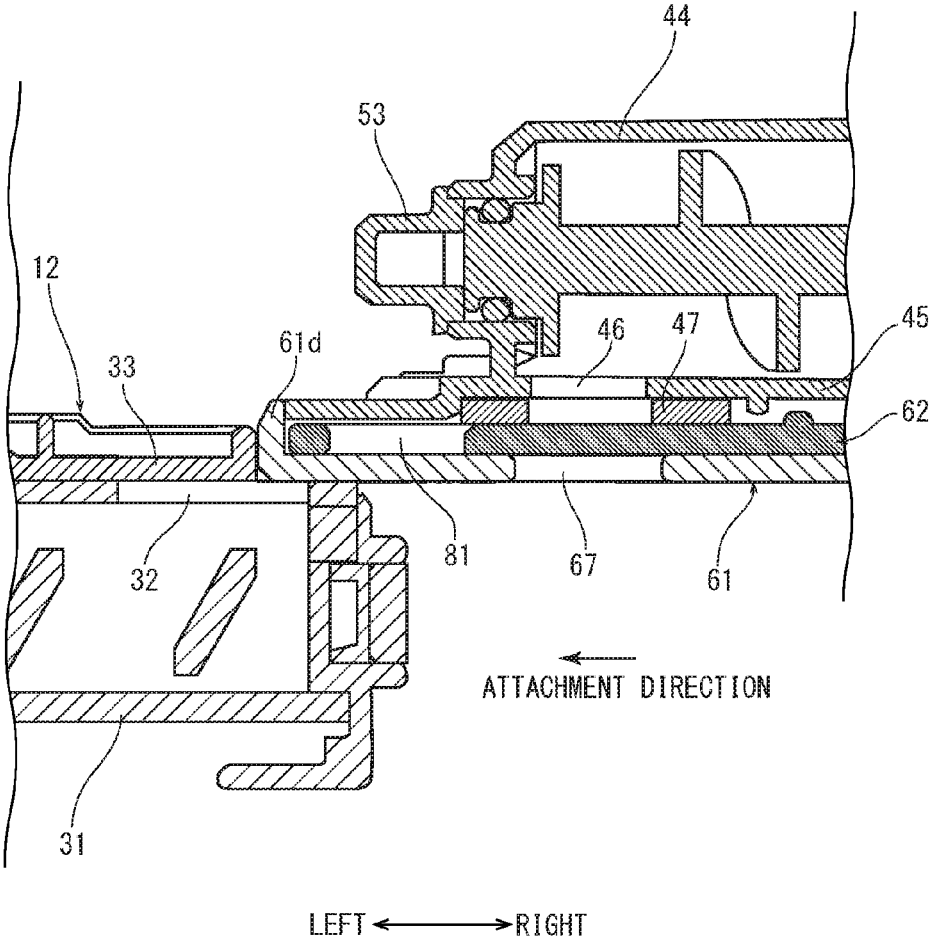
FIG. 12 is a sectional view showing the shutter mechanism and a development unit when the opening operation is started, in the color printer according to the embodiment of the present disclosure.

In addition, as shown in FIG. 12, the left side plate 61*d* of the container mount 61 abuts against a tip edge of the unit side shutter plate 33 by which the replenishment port 32 of the replenishment route 31 of the development unit 12 is closed. Then, the unit side shutter plate 33 slides into the open position against the biasing force of the biasing member and the container mount 61 starts to advance to the replenishment port 32.

Figure 13A:
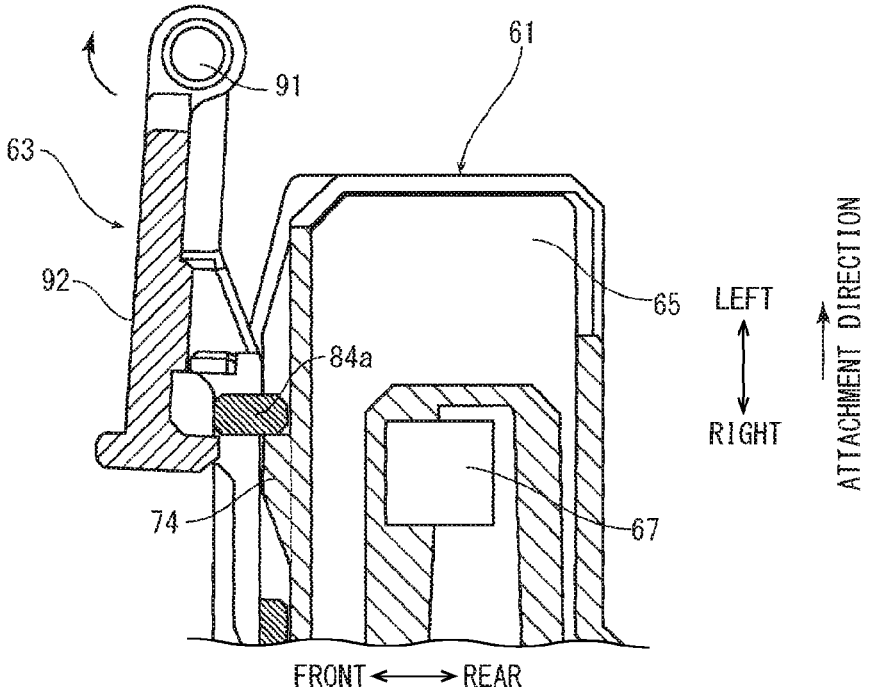
FIG. 13A is a sectional view showing the shutter mechanism sectioned horizontally at the upper stage part of the opening/closing hook when a turning of the opening/closing hook is started, in the color printer according to the embodiment of the present disclosure.
Figure 13B:
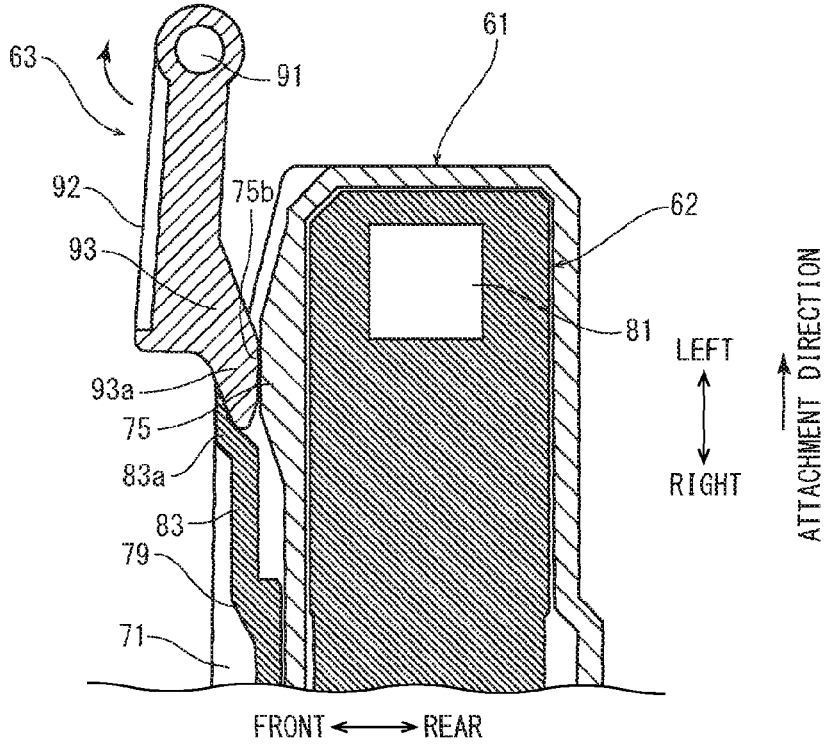
FIG. 13B is a sectional view showing the shutter mechanism sectioned horizontally at the lower stage part of the opening/closing hook when the turning of the opening/closing hook is started, in the color printer according to the embodiment of the present disclosure.

When the toner cartridge 27 is further slid in the attachment direction (the leftward direction), as shown in FIG. 13B, the hook claw 93*a* of the lower stage part 93 of the hook arm 92 is guided along the parallel face 75*b* of the guide part 75 of the container mount 61, gets into the inside of the shutter claw 83*a* of the lower arm part 83 of the shutter arm 79 and then engages with the shutter claw 83*a*. Then, the hook claw 93*a* is pressed by the guide part 75 in the outward direction, that is, in the forward direction. As the result, the hook arm 92 starts to turn forward around the supporting shaft 91, as indicated by the arrows of FIG. 13A and FIG. 13B.

By the turning of the hook arm 92, the shutter claw 83*a* with which the hook claw 93*a* engages is pressed forward and then the shutter arm 79 starts to elastically deform so as to open outward. If the shutter arm 79 elastically deforms outward, as shown in FIG. 13A, the engagement part 84*a* starts to be spaced forward away from the abutment part 74 of the container mount 61.

Figure 14:
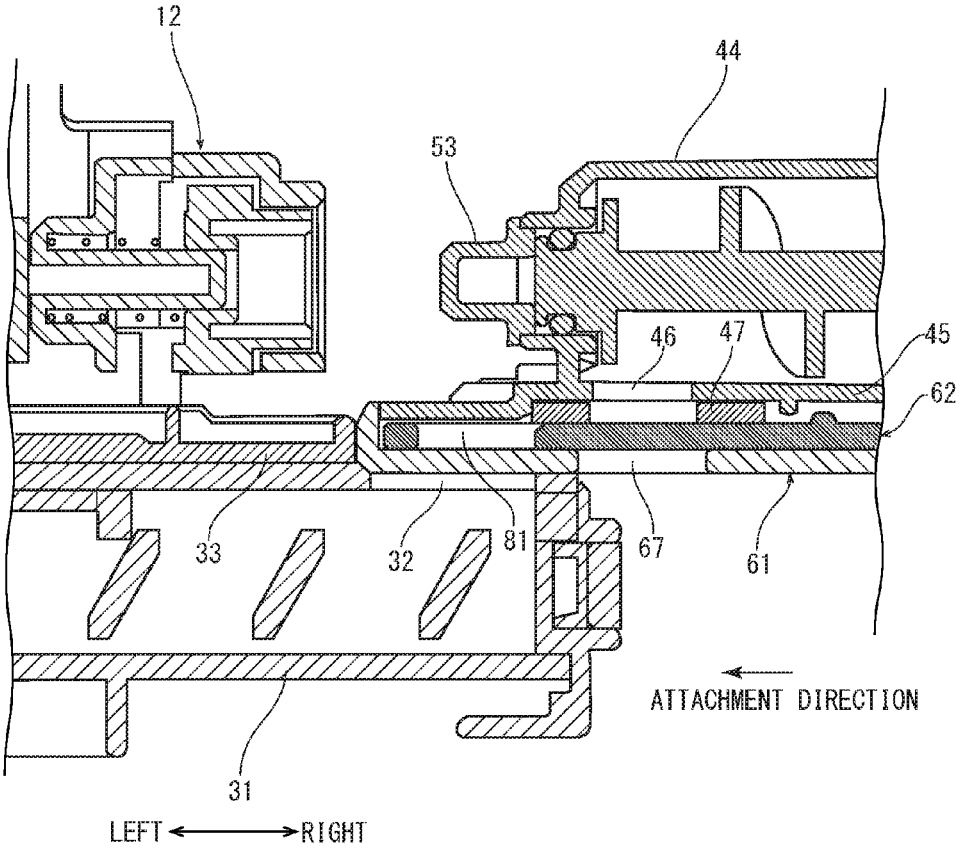
FIG. 14 is a sectional view showing the shutter mechanism and the development unit when the tuning of the opening/closing hook is started, in the color printer according to the embodiment of the present disclosure.

In addition, as shown in FIG. 14, the unit side shutter plate 33 of the development unit 12 is further pressed by the container mount 61 and then retracts from the replenishment port 32 while the container mount 61 advances to the replenishment port 32.

Figure 15A:
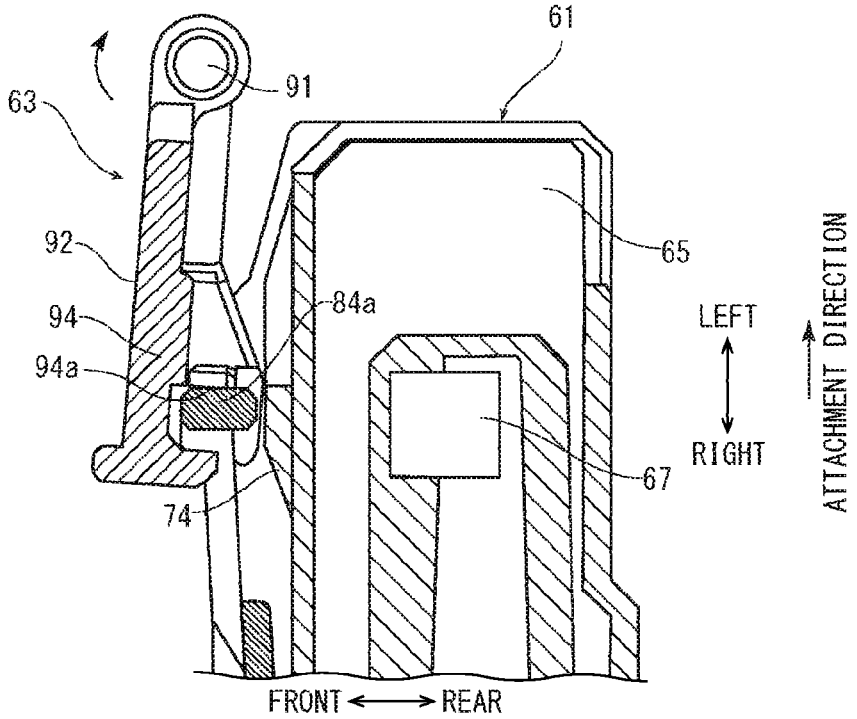
FIG. 15A is a sectional view showing the shutter mechanism sectioned horizontally at the upper stage part of the opening/closing hook when a sliding operation of the shutter plate in a direction of an opening position is started, in the color printer according to the embodiment of the present disclosure.
Figure 15B:
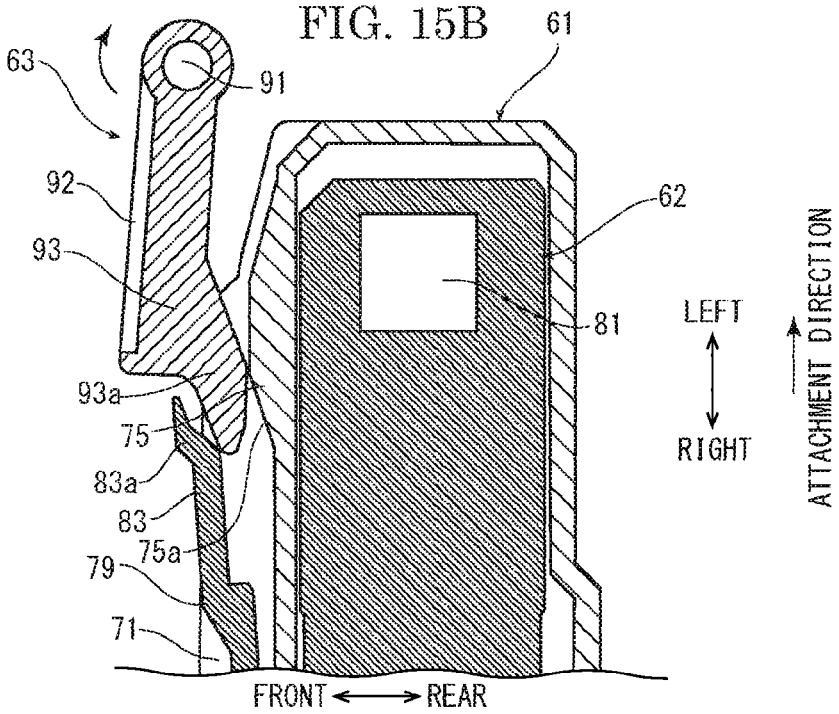
FIG. 15B is a sectional view showing the shutter mechanism sectioned horizontally at the lower stage part of the opening/closing hook when the sliding operation of the shutter plate in the direction of the opening position is started, in the color printer according to the embodiment of the present disclosure.

If the toner cartridge 27 is further slid in the attachment direction, as shown in FIG. 15B, the hook claw 93*a* of the lower stage part 93 of the hook arm 92 further gets into the inside of the lower arm part 83 of the shutter arm 79. Also, an outer face of the hook claw 93*a* moves along the right inclined face 75*a* from the parallel face 75*b* of the guide part 75 of the container mount 61 and then the hook arm 92, as indicated by the arrows of FIG. 15A and FIG. 15B, turns further forward around the supporting shaft 91.

By the turning of the hook arm 92, the shutter arm 79 further elastically deforms outward until protruding forward from the groove part 71, and as shown in FIG. 15A, the engagement part 84*a* is spaced outward away from the abutment part 74 of the container mount 61. At the same time, the engagement part 84*a* spaced away from the abutment part 74 abuts against the inner abutment face 94*a* of the upper stage part 94 of the hook arm 92. Namely, by disengaging with the container mount 61, the shutter plate 62 is permitted to slide with respect to the container mount 61 and is not permitted to slide with respect to the opening/closing hook 63, that is, with respect to the apparatus main body 2.

Figure 16:
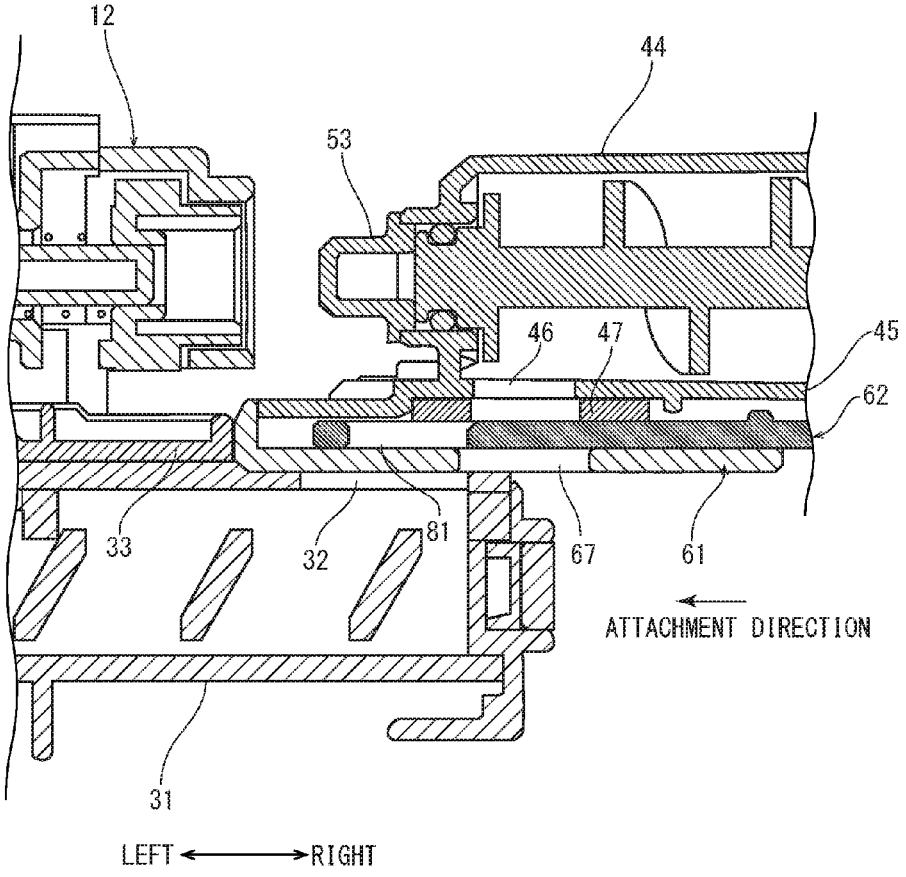
FIG. 16 is a sectional view showing the shutter mechanism and the development unit when a sliding operation of the shutter plate in the direction of the opening position is started, in the color printer according to the embodiment of the present disclosure.

Therefore, as shown in FIG. 16, the shutter plate 62 starts to slide forward (rightward) in the attachment direction relative to the container mount 61, that is, in the direction toward the open position. Thus, the shutter plate 62 is configured to slide in the direction toward the open position after the toner cartridge 27 is attached to the apparatus main body 2 to a certain extent. In addition, the container mount 61 further advances leftward over the replenishment port 32 of the development unit 12 and then the communication port 67 of the container mount 61 starts to communicate with the replenishment port 32.

Figure 17A:
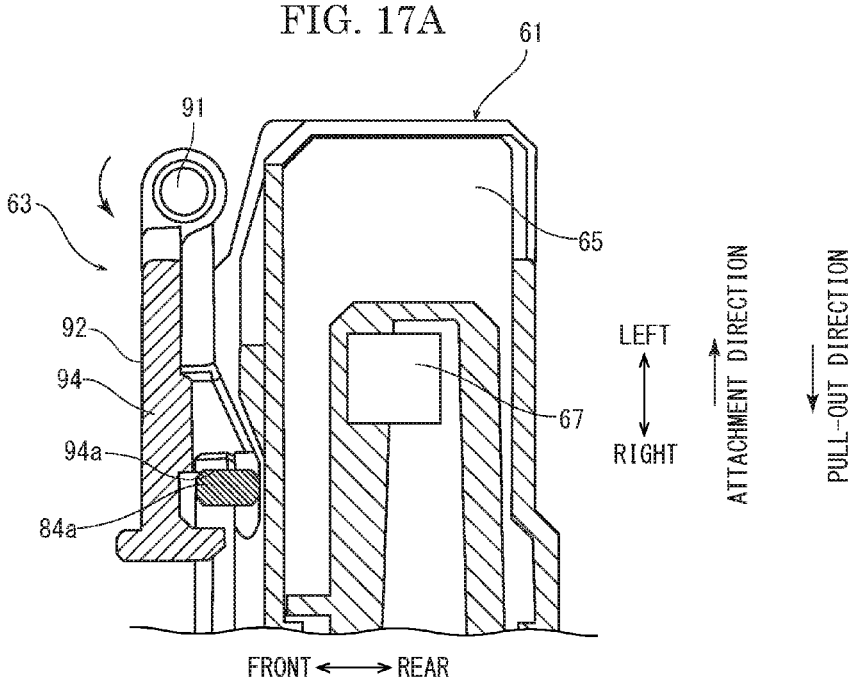
FIG. 17A is a sectional view showing the shutter mechanism sectioned horizontally at the upper stage part of the opening/closing hook when the opening operation is completed, in the color printer according to the embodiment of the present disclosure.
Figure 17B:
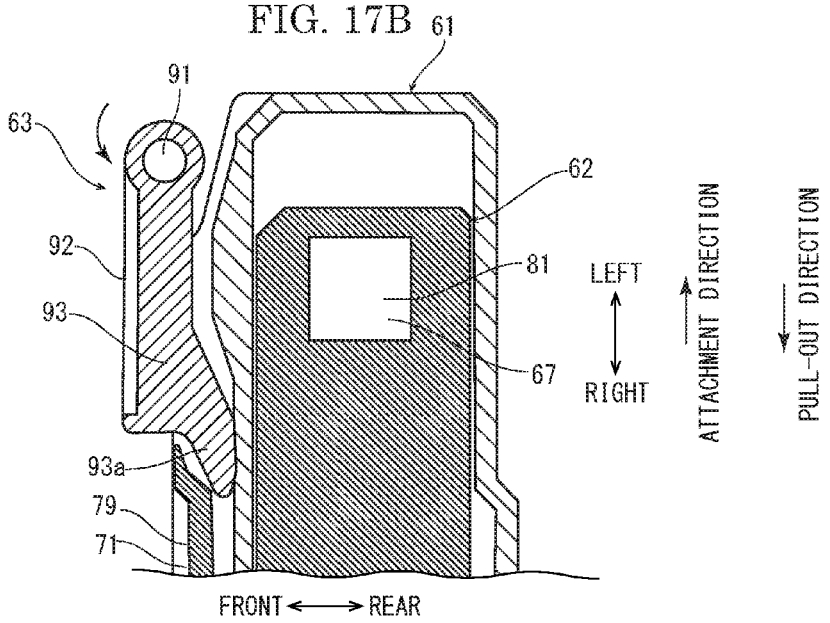
FIG. 17B is a sectional view showing the shutter mechanism sectioned horizontally at the lower stage part of the opening/closing hook when the opening operation is completed, in the color printer according to the embodiment of the present disclosure.

When the toner cartridge 27 is further slid in the attachment direction, as shown in FIG. 17B, the hook claw 93*a* of the lower stage part 93 of the hook arm 92 is spaced away from the shutter arm 79 and away from the guide part 75 of the container mount 61. In this manner, as indicated by the arrows of FIG. 17A and FIG. 17B, the hook arm. 92 turns rearward around the supporting shaft 91. Also, since the force pressed outward is released, the shutter arm 79 is housed in the groove part 71 with the engagement part 84*a* abutting against the inner abutment face 94*a* of the hook arm 92.

Figure 18:
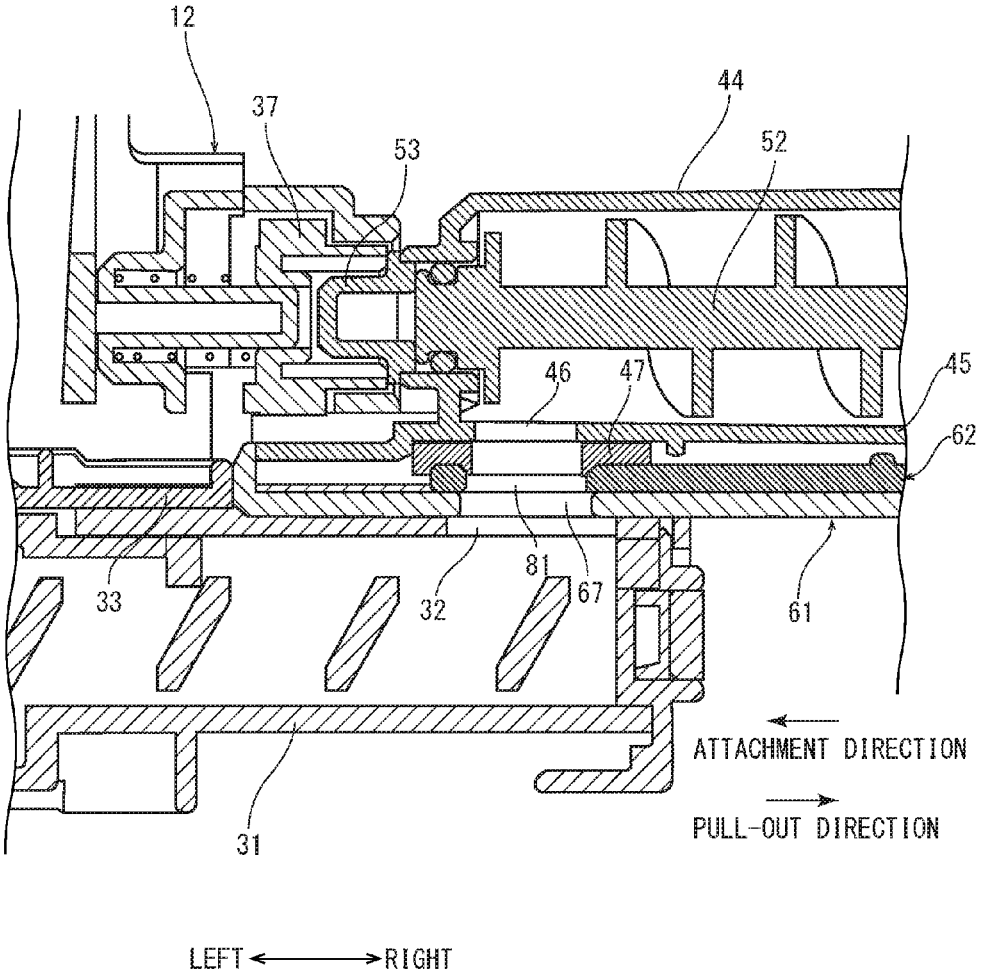
FIG. 18 is a sectional view showing the shutter mechanism and the development unit when the opening operation is completed, in the color printer according to the embodiment of the present disclosure.

Afterwards, as shown in FIG. 18, the shutter plate 62 slides to the open position relative to the container mount 61 and the opening 81 of the shutter plate 62 communicates with the communication port 67 of the container mount 61. Further, the communication port 67 of the container mount 61 communicates with the replenishment port 32 of the development unit 12. Moreover, the driven coupling 53 provided at the tip end face of the agitating screw 52 supported in the communication route 44 is coupled with the driving coupling 37 of the development unit 12.

As described above, the supply port 46 of the toner storage part 41 and the replenishment port 32 of the development unit 12 communicate with each other via the opening 81 of the shutter plate 62 and the communication port 67 of the container mount 61 in the vertical direction. This makes it possible to replenish the toner from the toner storage part 41 into the development unit 12. If the driving coupling 37 of the development unit 12 rotates, the agitating screw 52 rotates together with the driven coupling 53, and the toner is supplied from the toner storage part 41 through the communication route 44 and then drops into the replenishment route 31 of the development unit 12 through the supply port 46, the opening 81 and the replenishment port 32 which are communicated with each other.

Figure 19A:
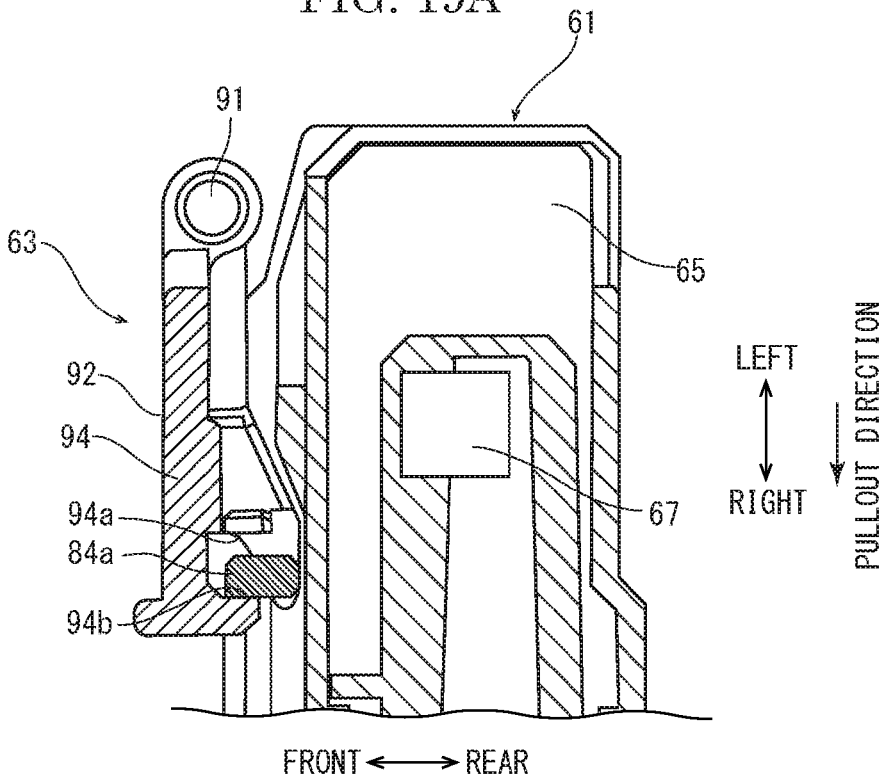
FIG. 19A is a sectional view showing the shutter mechanism sectioned horizontally at the upper stage part of the opening/closing hook when a closing operation is started, in the color printer according to the embodiment of the present disclosure.

Next, with reference to FIG. 13 and FIG. 19 to FIG. 22, the closing operation of the shutter mechanism 55 will be described. FIG. 19 and FIG. 21 each are a plan view illustrating the closing operation of the shutter mechanism. "A" of each figure is a sectional view showing the shutter mechanism sectioned horizontally at the upper stage part of the opening/closing hook. "B" of each figure is a sectional view showing the shutter mechanism sectioned horizontally at the lower stage part of the opening/closing hook. FIG. 20 and FIG. 22 each are a sectional side view illustrating the closing operation of the replenishment port of the development unit.

Figure 19B:
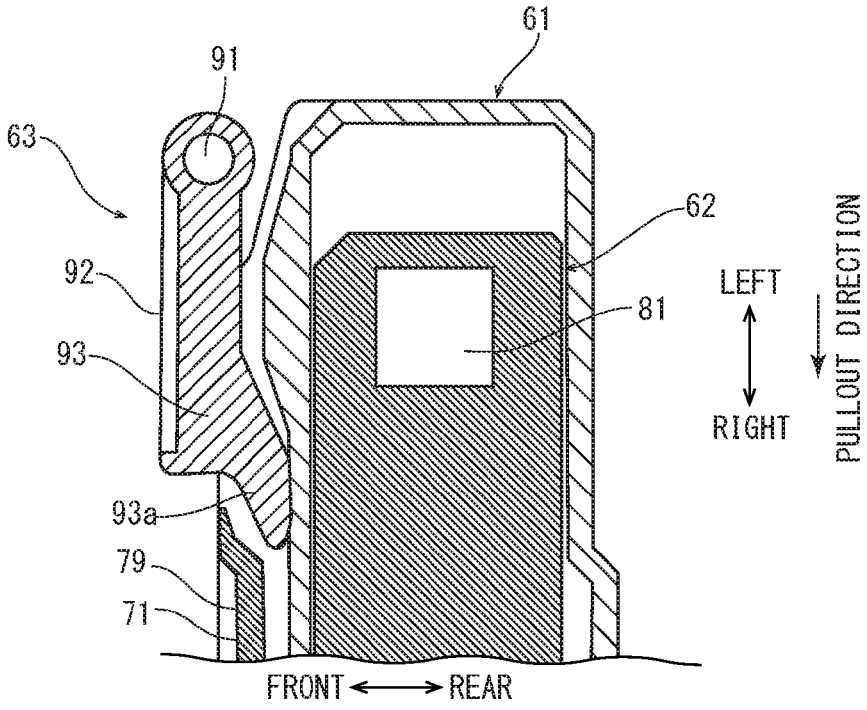
FIG. 19B is a sectional view showing the shutter mechanism sectioned horizontally at the lower stage part of the opening/closing hook when the closing operation is started, in the color printer according to the embodiment of the present disclosure.
Figure 20:
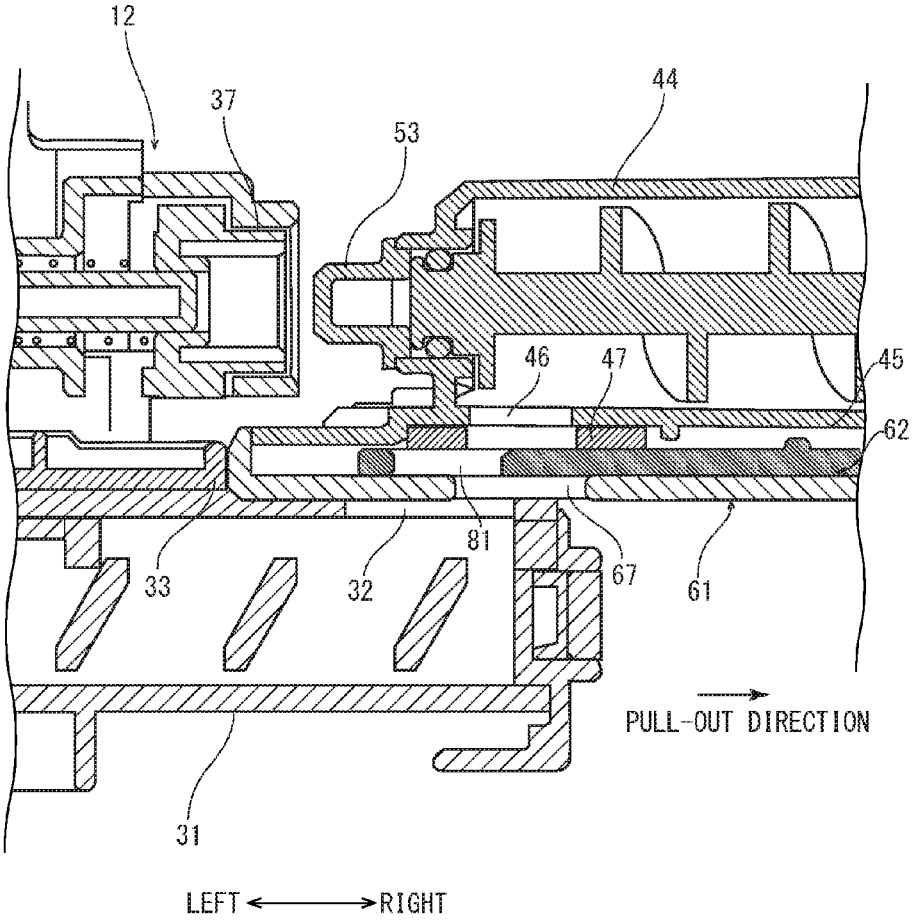
FIG. 20 is a sectional view showing the shutter mechanism and the development unit when the closing operation is started, in the color printer according to the embodiment of the present disclosure.

From the toner replenishment possible state shown in FIG. 17A, FIG. 17B, and FIG. 18, when the toner cartridge 27 is pulled out rightward, as shown in FIG. 19B, the hook arm 92 moves to the depth side in the pullout direction (the left direction) relative to the container mount 61 along the groove part 71. Also, the shutter plate 62 moves together with the container mount 61 in the pullout direction (the right direction).

By the movement of the shutter plate 62, as shown in FIG. 19A, the engagement part 84*a* formed in the upper arm part 84 of the shutter arm 79 is spaced away from the inner abutment face 94*a* of the upper stage part 94 of the hook arm 92 and then abuts against the outer abutment face 94*b*. As the result, the shutter plate 62 is prevented from being slid in the pullout direction with respect to the opening/closing hook 63, that is, with respect to the apparatus main body 2.

Therefore, the shutter plate 62 starts to slide in the depth side (the left side) in the pullout direction relative to the container mount 61 to be pulled out, that is, in the closing direction. Then, as shown in FIG. 20, the opening 81 of the shutter plate 62 starts to be spaced away from the communication port 67 of the container mount 61. Further, the communication port 67 of the container mount 61 is slightly spaced away from the replenishment port 32 of the development unit 12, and the unit side shutter plate 33 is biased by the biasing member to advance into the replenishment port 32. Also, the driven coupling 53 is spaced away from the driving coupling 37.

Figure 21A:
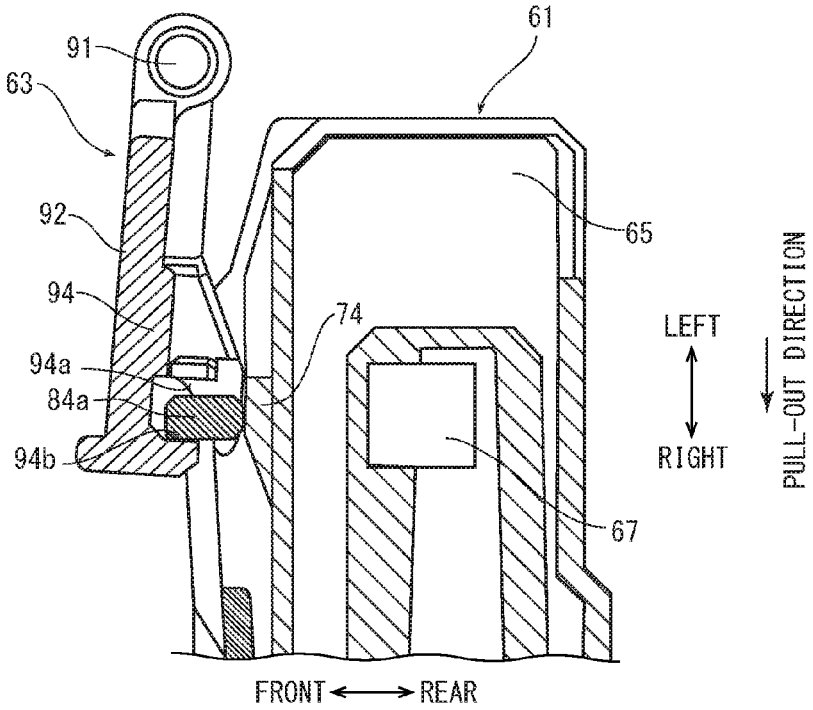
FIG. 21A is a sectional view showing the shutter mechanism sectioned horizontally at the upper stage part of the opening/closing hook when a sliding operation of the shutter plate in the direction of a closing position is started, in the color printer according to the embodiment of the present disclosure.
Figure 21B:
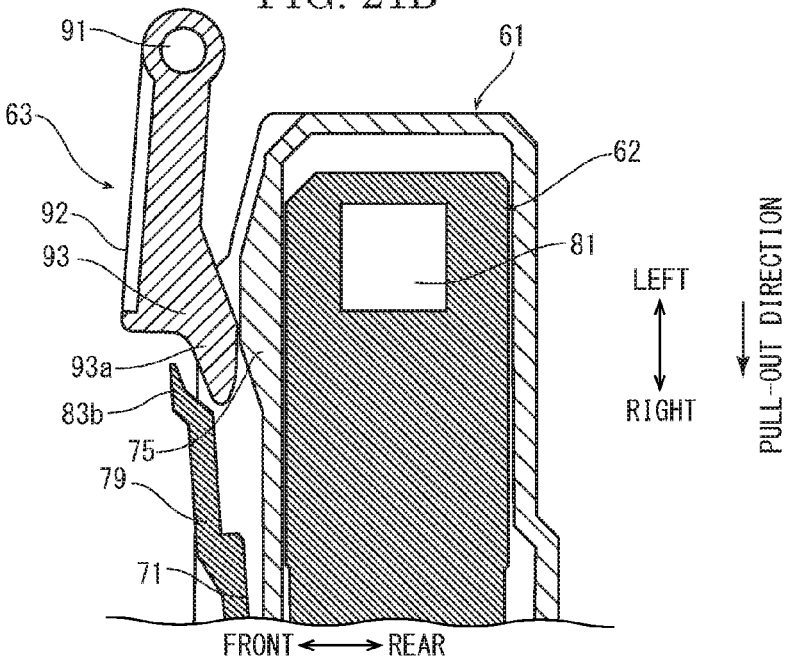
FIG. 21B is a sectional view showing the shutter mechanism sectioned horizontally at the lower stage part of the opening/closing hook when the sliding operation of the shutter plate in the direction of the closing position is started, in the color printer according to the embodiment of the present disclosure.
Figure 22:
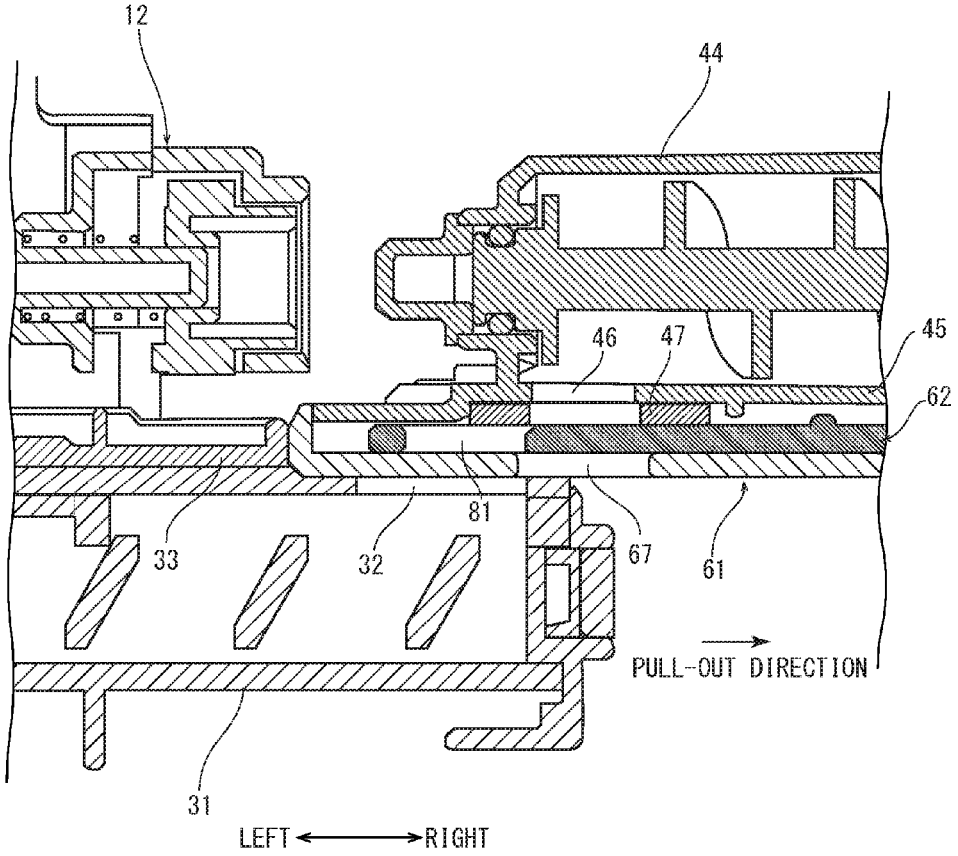
FIG. 22 is a sectional view showing the shutter mechanism and the development unit when the sliding operation of the shutter plate in the direction of the closing position is started, in the color printer according to the embodiment of the present disclosure.

When the toner cartridge 27 is further pulled out, as shown in FIG. 21A, the shutter arm 79 slide along the abutment part 74 with the engagement part 84*a* of the shutter arm 79 abutting against the outer abutment face 94*b* of the hook arm 92 and then the shutter arm 79 elastically deforms so as to open outward. In addition, as shown in FIG. 21B, the hook claw 93*a* of the hook arm 92 starts to slide along the parallel face 75*b* from the right inclined face 75*a* of the guide part 75 of the container mount 61 and then the hook arm 92 turns outward.

Then, as shown in FIG. 22, the shutter plate 62 slides into the close position where the opening 81 is completely spaced away from the communication port 67 of the container mount 61, and the communication port 67 of the container mount 61 retracts from the replenishment port 32 of the development unit 12.

When the toner cartridge 27 is further pulled out and then the engagement part 84*a* of the shutter arm 79 reaches the end face 74*c* of the abutment part 74 of the container mount 61, as shown in FIG. 13A, the shutter arm 79 is biased so as to turn backward owing to its elasticity. That is, as soon as the engagement part 84*a* is spaced away from the outer abutment face 94*b* of the hook arm 92, the engagement part 84*a* engages with the end face 74*c* of the abutment part 74 of the container mount 61. As the results, the shutter plate 62 is released from the slide prevention with respect to the apparatus main body 2 and permitted to be moved together with the container mount 61.

In addition, as shown in FIG. 13B, since the hook claw 93*a* of the hook arm 92 abuts against the guide part 75 of the container mount 61 and then the hook arm 92 turns forward, the opening/closing hook 63 does not interfere with the shutter arm 79 housed in the groove part 71 when the container mount 61 is pulled out. Therefore, the container mount 61 can be pulled out without any resistance.

As described hereinabove, according to the toner cartridge 27 of the present disclosure, the shutter plate 62 is slid relative to the container mount 61 by the opening/closing hook 63 so that the supply port 46 of the toner storage part 41 can be opened or closed. The opening/closing hook 63 is disposed on the front side of the toner cartridge 27, that is, on one side in the direction crossing the attachment/detachment direction (the left and right directions) of the toner cartridge 27. Therefore, the shutter mechanism 55 can be installed in a small space. Accordingly, in a case where the development unit 12 and the drum unit 11 are disposed close to each other or in a case where a distance between the image forming units 10 is short, the shutter mechanism 55 can be disposed in a small space.

In addition, a function in which the shutter arm 79 of the shutter plate 62 is elastically deformed so as to open on the one side and a function in which the shutter plate 62 is moved relative to the container mount 61 to thereby open and close the communication port 67 are divided into the upper section and the lower section of each of the container mount 61, the shutter plate 62 and the opening/closing hook 63.

That is, the function in which the shutter arm 79 of the shutter plate 62 is elastically deformed so as to open on the one side is performed by the guide part 75 of the container mount 61, the shutter claw 83*a* of the shutter arm 79 and the hook claw 93*a* of the opening/closing hook 63. The guide part 75, the shutter claw 83*a* and the hook claw 93*a* are disposed at the second height position. Also, the function in which the shutter plate 62 is moved relative to the container mount 61 to thereby open and close the communication port 67 is performed by the abutment part 74 of the container mount 61, the engagement part 84*a* of the shutter arm 79, and the inner and outer abutment faces 94*a*, 94*b* of the opening/closing hook 63. The abutment part 74, the engagement part 84*a* and the inner and outer abutment faces 94*a*, 94*b* are disposed at the first height position higher than the second height position.

By dividing the above two functions into the upper section and the lower section, it makes possible to make the sizes of the container mount 61 and the opening/closing hook 63 small. In particular, a length along the attachment/detachment direction of the toner cartridge 27 can be reduced. Incidentally, the guide part 75 of the container mount 61, the shutter claw 83*a* of the shutter arm 79 and the hook claw 93*a* of the opening/closing hook 63 may be disposed at the first height position while the abutment part 74 of the container mount 61, the engagement part 84*a* of the shutter arm 79, and the inner and outer abutment faces 94*a*,

94*b* of the opening/closing hook 63 may be disposed at the second height position lower than the first height position.

In addition, since the communication port 67 is formed in the container mount 61 at the position on the front side in the attachment direction from the tip end of the container mount 61 in the attachment direction, that is, at the position closer to the left end portion from the center portion in the left and right directions, when the toner cartridge 27 is attached to the apparatus main body 2, the shutter plate 62 is configured to be slid into the open position after the toner cartridge 27 is attached in a certain extent. In detail, the shutter plate 62 starts to slide to the open position after the toner cartridge 27 is attached to the apparatus main body 2 in a certain extent, the unit side shutter plate 33 by which the replenishment port 32 of the development unit 12 is closed is retracted by the container mount 61 and then the container mount 61 is caused to advance to the replenishment port 32.

Namely, an opening timing of the replenishment port 32 of the development unit 12 when the toner cartridge 27 is attached is earlier than an opening timing of the communication port 67. Therefore, since the communication port 67 is opened after the toner cartridge 27 is attached to the apparatus main body 2, it becomes possible to restrain scattering of the toner to be discharged from the toner storage part 41 at the time of attachment of the toner cartridge.

In addition, with the above construction, since a closing timing of the communication port 67 is earlier than a closing timing of the replenishment port 32 of the development unit 12, the toner cartridge 27 is detached from the apparatus main body 2 after the communication port 67 of the toner cartridge 27 is closed. Therefore, it is possible to restrain scattering of the toner at the time of detachment of the toner cartridge.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a toner container attached to or detached from an apparatus main body along a predetermined attachment/detachment direction, the toner container having a passing port through which a toner is supplied or discharged; and a shutter mechanism configured to open or close the passing port, wherein the shutter mechanism includes:

a container mount attached to the toner container;

a shutter plate supported on the container mount so as to be slidable along the attachment/detachment direction; and an opening/closing hook supported on the apparatus main body on one side of the container mount in a direction crossing the attachment/detachment direction, wherein the container mount has:

a mount side engagement part protruding from a side face on an opening/closing hook side of the container mount toward the opening/closing hook; and a guide part protruding from the side face on the opening/closing hook side of the container mount toward the opening/closing hook and extending along the attachment/detachment direction, the shutter plate has:

a shutter arm supported in a cantilever manner on a side face on an opening/closing hook side of the shutter plate, wherein the shutter arm has a shutter side engagement part capable of engaging with the mount side engagement part, and the opening/closing hook has:

a hook arm biased towards the side face on the opening/closing hook side of the container mount, wherein the hook arm has a hook claw which is guided along the guide part in accordance with the attachment/detachment of the toner container and is engaged with the shutter arm to move the shutter arm toward the opening/closing hook so as to disengage the shutter side engagement part with the mount side engagement part, and wherein the disengagement of the shutter side engagement part with the mount side engagement part by the hook claw makes it possible to slide the shutter plate relative to the container mount and then to open or close the passing port.

2. The image forming apparatus according to claim 1, wherein the hook arm has:

a depth side engagement part provided on a downstream side in the attachment direction so as to be able to be engaged with the shutter side engagement part; and a front side engagement part provided on an upstream side in the attachment direction so as to be able to be engaged with the shutter side engagement part, when the toner container is attached, the shutter side engagement part is engaged with the depth side engagement part so that the shutter plate slides relative to the container mount so as to open the passing port, and when the toner container is detached, the shutter side engagement part is engaged with the front side engagement part so that the shutter plate slides relative to the container mount so as to close the passing port.

3. The image forming apparatus according to claim 2, wherein the mount side engagement part and the guide part are formed vertically arranged on the side face on the opening/closing hook side of the container mount and the depth side engagement part and the front side engagement part, and the hook claw are formed vertically arranged in the opening/closing hook.

4. The image forming apparatus according to claim 1, wherein the shutter arm has a shutter claw which is engaged with the hook claw.

5. The image forming apparatus according to claim 4, wherein the shutter side engagement part and the shutter claw are formed vertically arranged in the shutter arm and the depth side engagement part and the front side engagement part, and the hook claw are formed vertically arranged in the opening/closing hook.

6. The image forming apparatus according to claim 1, comprising:

a development unit configured to develop an electrostatic latent image formed on an image carrier by toner, a drum unit provided with a cleaning device configured to remove the toner remained on the image carrier, a toner storage part configured to store toner to be supplied into the development unit; and a toner collection part configured to store the toner discharged from the cleaning device of the drum unit, wherein at least one of the toner storage part and the toner correction part is the toner container.

7. The image forming apparatus according to claim 1, wherein the development unit and the drum unit each have an openable/closable receptacle port which communicates with the passing port, an opening timing of the receptacle port is earlier than an opening timing of the passing port and a closing timing of the passing port is earlier than a closing timing of the receptacle port.

8. The image forming apparatus according to claim 1, wherein the container mount has a communication port configured to communicate with the passing port of the toner container by sliding the shutter plate relative to the container mount and the communication port is formed at an end portion on a downstream side in the attachment direction of the container mount.

* * * * *